US008016683B2

(12) United States Patent
Cole

(10) Patent No.: US 8,016,683 B2
(45) Date of Patent: Sep. 13, 2011

(54) GAMING CABINET CONSTRUCTED FROM CONNECTABLE COMPONENTS

(75) Inventor: Joseph W. Cole, North Las Vegas, NV (US)

(73) Assignee: Cole Kepro International, LLC, North Las Vegas, NV (US)

( * ) Notice: Subject to any disclaimer, the term of this patent is extended or adjusted under 35 U.S.C. 154(b) by 1189 days.

(21) Appl. No.: 11/786,567

(22) Filed: Apr. 11, 2007

(65) Prior Publication Data

US 2007/0197301 A1 Aug. 23, 2007

Related U.S. Application Data

(63) Continuation-in-part of application No. 11/589,685, filed on Oct. 30, 2006.

(60) Provisional application No. 60/732,043, filed on Oct. 31, 2005.

(51) Int. Cl.
*A63F 9/24* (2006.01)

(52) U.S. Cl. ..... 463/46; 273/138.1

(58) Field of Classification Search ..... 463/46; 273/138.1; 312/9.48

See application file for complete search history.

(56) References Cited

U.S. PATENT DOCUMENTS

| | | | | |
|---|---|---|---|---|
| 5,951,131 | A | 9/1999 | Stefan | |
| 6,135,884 | A | 10/2000 | Hedrick et al. | |
| 6,368,216 | B1 | 4/2002 | Hedrick et al. | |
| 6,641,484 | B2 * | 11/2003 | Oles et al. | 463/47 |
| 6,820,875 | B1 | 11/2004 | Hedrick et al. | |
| 6,860,814 | B2 * | 3/2005 | Cole | 463/46 |
| 7,641,556 | B2 * | 1/2010 | Tedsen et al. | 463/46 |
| 2005/0215325 | A1 * | 9/2005 | Nguyen et al. | 463/46 |
| 2006/0070527 | A1 * | 4/2006 | Chapman et al. | 96/417 |
| 2006/0073900 | A1 * | 4/2006 | Cole | 463/46 |
| 2007/0054742 | A1 * | 3/2007 | McComb et al. | 463/46 |
| 2008/0146326 | A1 * | 6/2008 | Morrow et al. | 463/26 |

* cited by examiner

*Primary Examiner* — Masud Ahmed
(74) *Attorney, Agent, or Firm* — Weide & Miller, Ltd.

(57) ABSTRACT

A gaming machine cabinet or housing is constructed from a plurality of connected components. In one embodiment, the cabinet is assembled from base, side, top, back and door components or sections. The housing may have a basis configuration constructed from a base, sides, top, back and a first door. The housing may have a plurality of modified configurations constructed from various of the basic configuration components, such as the base, sides and back, and an extension and modified door. In accordance with the invention, the gaming machine housing may be manufactured in one location and then conveniently shipped in unassembled form to another location for assembly and use. The gaming machine housing may also be constructed in a variety of configurations utilizing a small number of components.

4 Claims, 29 Drawing Sheets

GAMING CABINET CONSTRUCTED FROM CONNECTABLE COMPONENTS

RELATED APPLICATION DATA

This application is a continuation-in-part of U.S. application Ser. No. 11/589,685, filed Oct. 30, 2006, which claims priority to U.S. Provisional Application Ser. No. 60/732,043, filed Oct. 31, 2005.

FIELD OF THE INVENTION

The present invention relates to gaming machines and, particularly, gaming machines configured to present wagering-type games.

BACKGROUND OF THE INVENTION

A variety of configurations of gaming machines configured to present wagering games are well known. For example, one early gaming machine was the mechanical slot machine. This machine accepted coins and had spinning reels.

A variety of newer electronic and electro-mechanical gaming machines have been developed. For example, slot machines now often include mechanical reels which are controlled by electric motors, which motors are themselves controlled by a computing device or electronic controller. In addition, video gaming devices have been developed which are configured to present game information electronically via one or more electronically-controlled displays.

There are numerous problems when considering the cost of manufacturing and developing these gaming machines. First, each machine is generally designed to present a specific game. The machine includes a secure cabinet which contains the game machine components. Generally, the cabinet is configured as a solid box.

In addition, the circuitry for each machine is generally specific to the particular machine. For example, the configuration of the controller, wiring and peripheral devices for a slot machine varies greatly from the configuration of a video gaming machine. This requires that a tremendous number of components be manufacture and assembled, in a variety of configurations, to create the variety of different gaming machines.

Because the gaming machines are assembled into a particular configuration, they are large and thus are not well-suited to being transported. Also, these particularly configured gaming machines are not suited for use in presenting other games. For example, a casino may purchase a gaming machine for many thousands of dollars. If the popularity of the game wanes, however, the gaming machine is not suited to presenting other games because the circuitry of the gaming machine is specific to the original game.

SUMMARY OF THE INVENTION

One aspect of the invention is a gaming machine housing or cabinet which is constructed from a plurality of individual components. The gaming machine housing or cabinet may be said to be "modular" in that it is constructed from basic elements or members.

In one configuration of a modular cabinet, the cabinet has a base, first and second sides, a back, a top and a front or door. These components may be configured to be connected to one another using simple connectors and using simple tools, such as by the purchaser of the cabinet. In one embodiment, the components are connected with threaded fasteners which extend through apertures in the components, such as at outwardly extending flanges thereof. The fasteners may be studs which extend out from one component towards another, bolts/screws or the like.

The base of the cabinet preferably rests upon a platform, whereby the connected sides, back and door are supported by the base independent of the platform or other support surface, ensuring the integrity of the cabinet. The mechanical connection of the components ensures efficient grounding of the cabinet and associated cabinets from electrical shock.

In one embodiment, other gaming machine elements, such as electrical components, are associated with the components or modules of the cabinet. For example, a gaming controller or a controller interface may be associated with a back of the cabinet. A display may be associated with the door. Wiring, connectors and the like may be associated with various of the components, such as the back, sides and/or door.

In one embodiment, the cabinet may have a base or basic configuration. Modified cabinet or housing configurations may be constructed by modifying the base configuration. For example, in one embodiment, the base housing configuration is constructed from a base, a pair of sides, a back, a top and a door. In one modified configuration, the size and appearance of the cabinet is changed by adding an extension to the base configuration. The extension may extend upwardly from the sides and back of the base configuration. A taller door may then be utilized. In one embodiment, sides and a back of the extension correspond to and become integral with the sides and back of the base configuration. In this configuration, the interior of the gaming machine housing also increases in size.

Further objects, features, and advantages of the present invention over the prior art will become apparent from the detailed description of the drawings which follows, when considered with the attached figures.

DETAILED DESCRIPTION OF THE INVENTION

The invention is a gaming machine, a method of assembling a gaming machine, and method of using a gaming machine. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One aspect of the invention is a modular gaming cabinet or housing. The gaming cabinet or housing may be said to be "modular" in the sense that it comprises basic individual components which may be assembled to form a completed gaming cabinet.

Another aspect of the invention is a gaming device. The gaming device comprises a secure housing with at least one internal controller. Another aspect of the invention is a gaming machine comprising a universal presentation platform which is configured to accept different gaming devices. In one embodiment, the presentation platform comprises the modular gaming cabinet of the invention configured with a universal gaming device interface (UGDI). Other aspects of the invention comprise methods of assembling a modular gaming cabinet and methods of using and/or operating a gaming machine.

Figure 1:
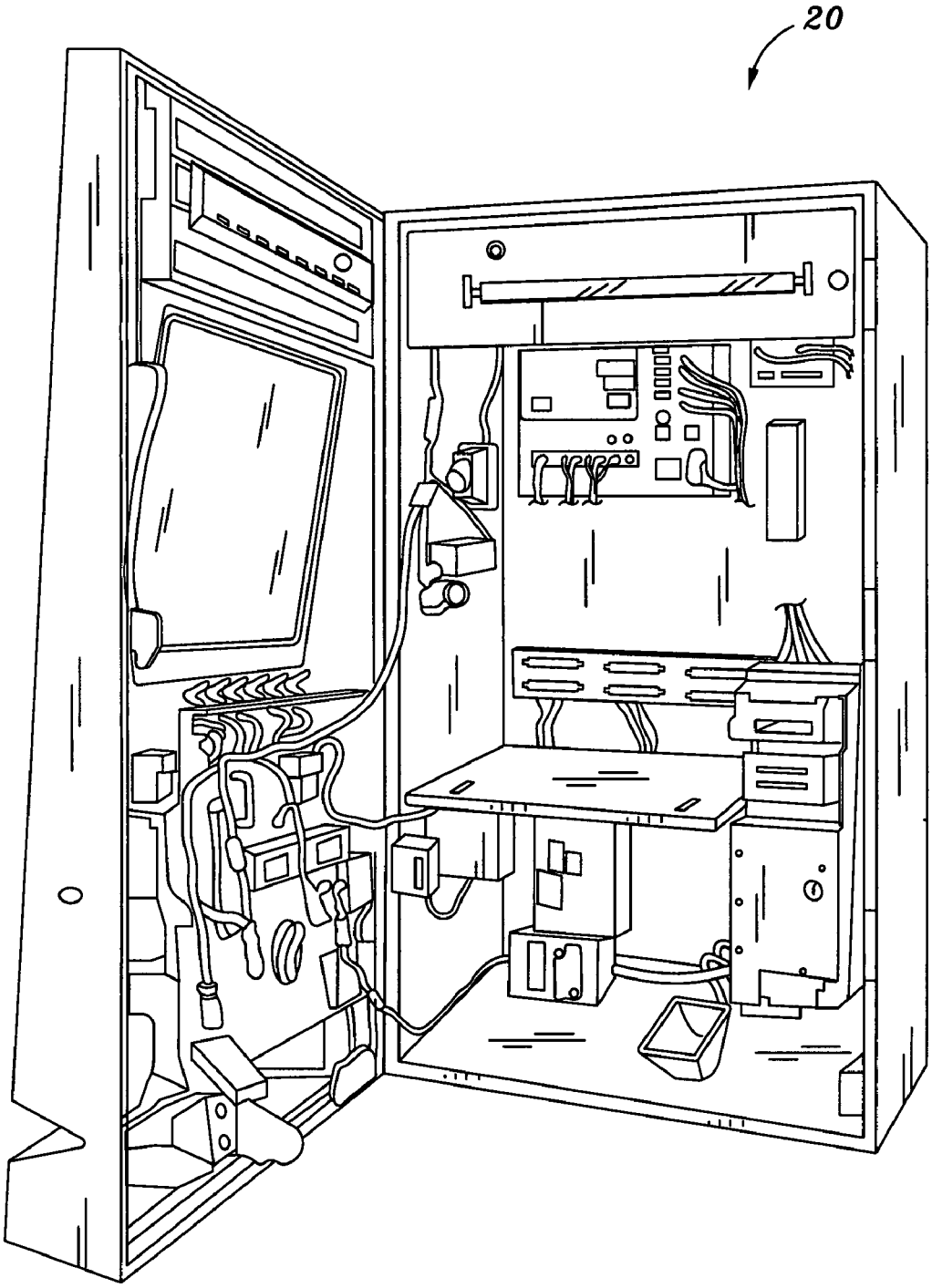
FIG. 1 is a perspective view of a gaming machine of the invention, the gaming machine comprising a universal presentation platform including a modular cabinet for accepting a gaming device.

A first aspect of the invention will be described with reference to FIGS. 1-7. This aspect of the invention comprises a modular gaming cabinet or housing 20. FIG. 1 illustrates the gaming cabinet 20 after it has been assembled from its individual components.

Figure 2:
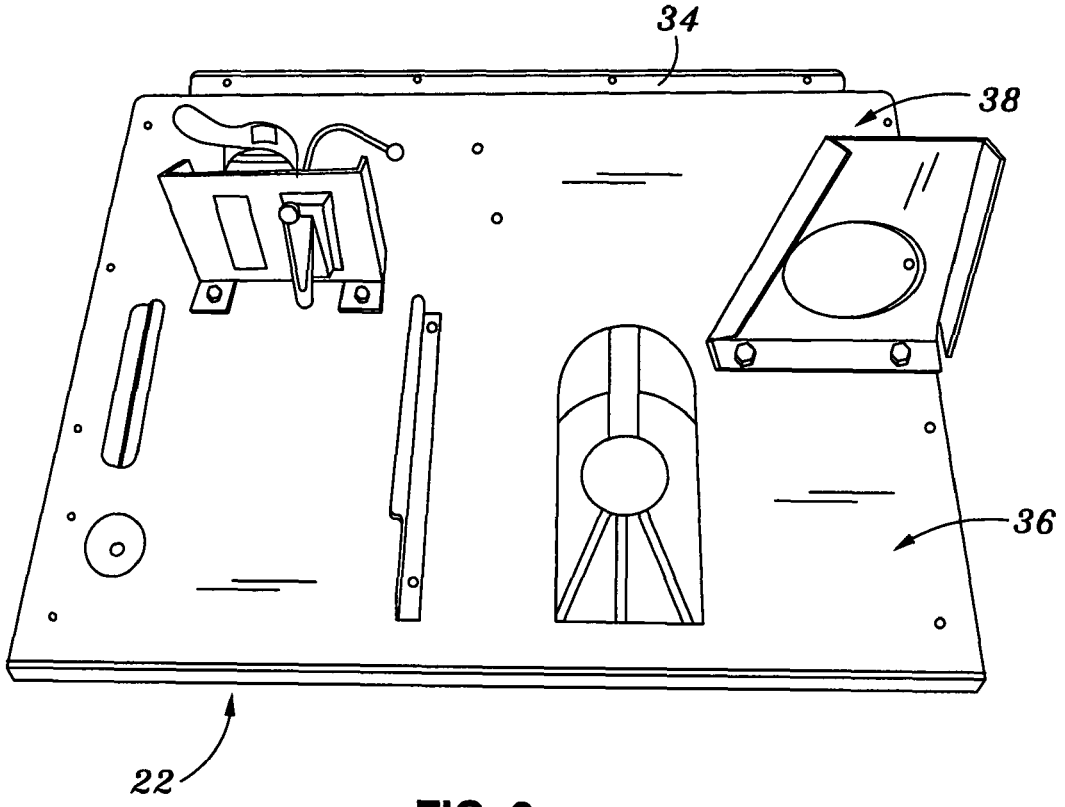
FIG. 2 illustrates a base of the modular gaming cabinet illustrated in FIG. 1.
Figure 3:
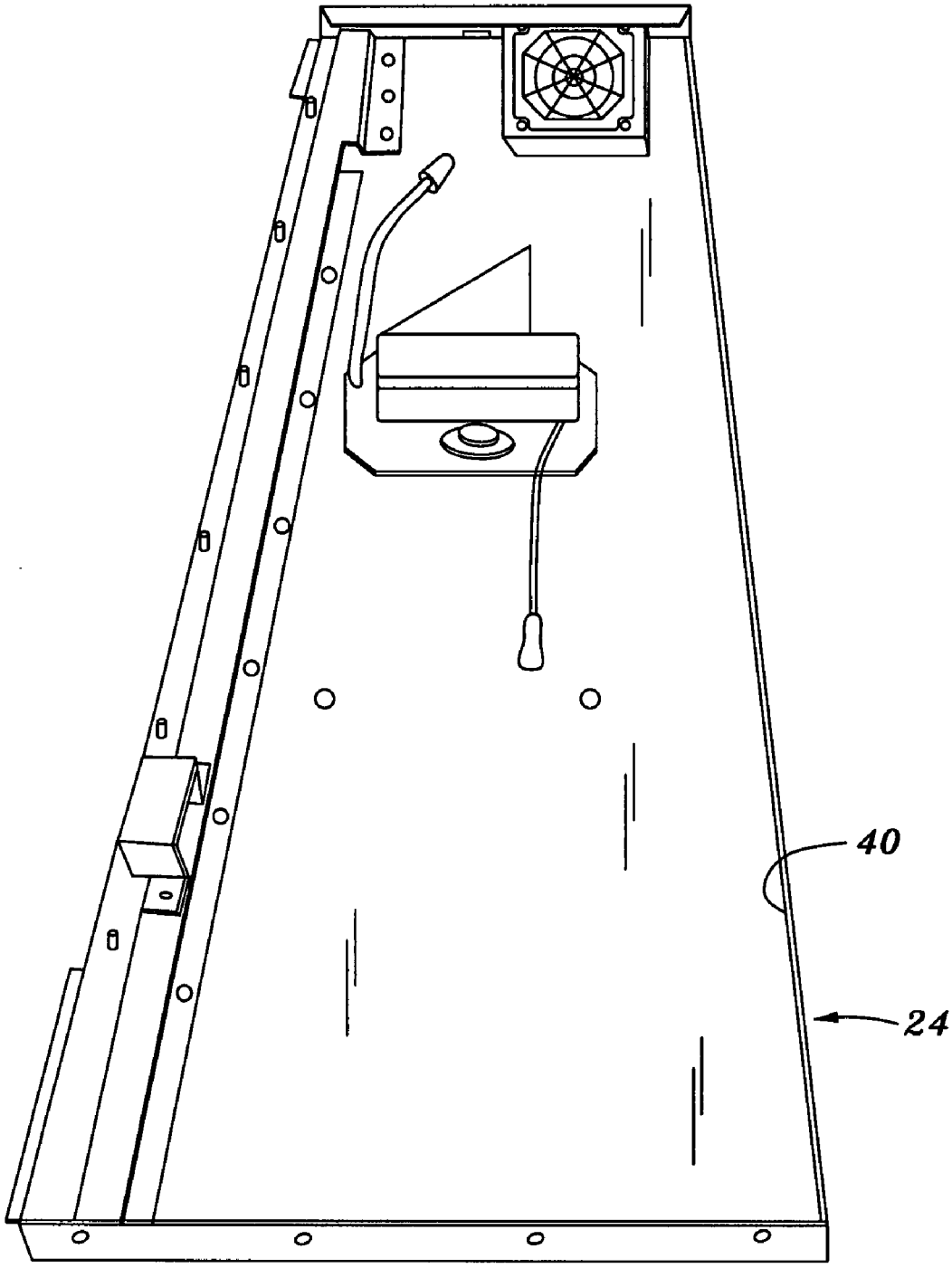
FIG. 3 illustrates a left side of the modular gaming cabinet illustrated in FIG. 1.
Figure 4:
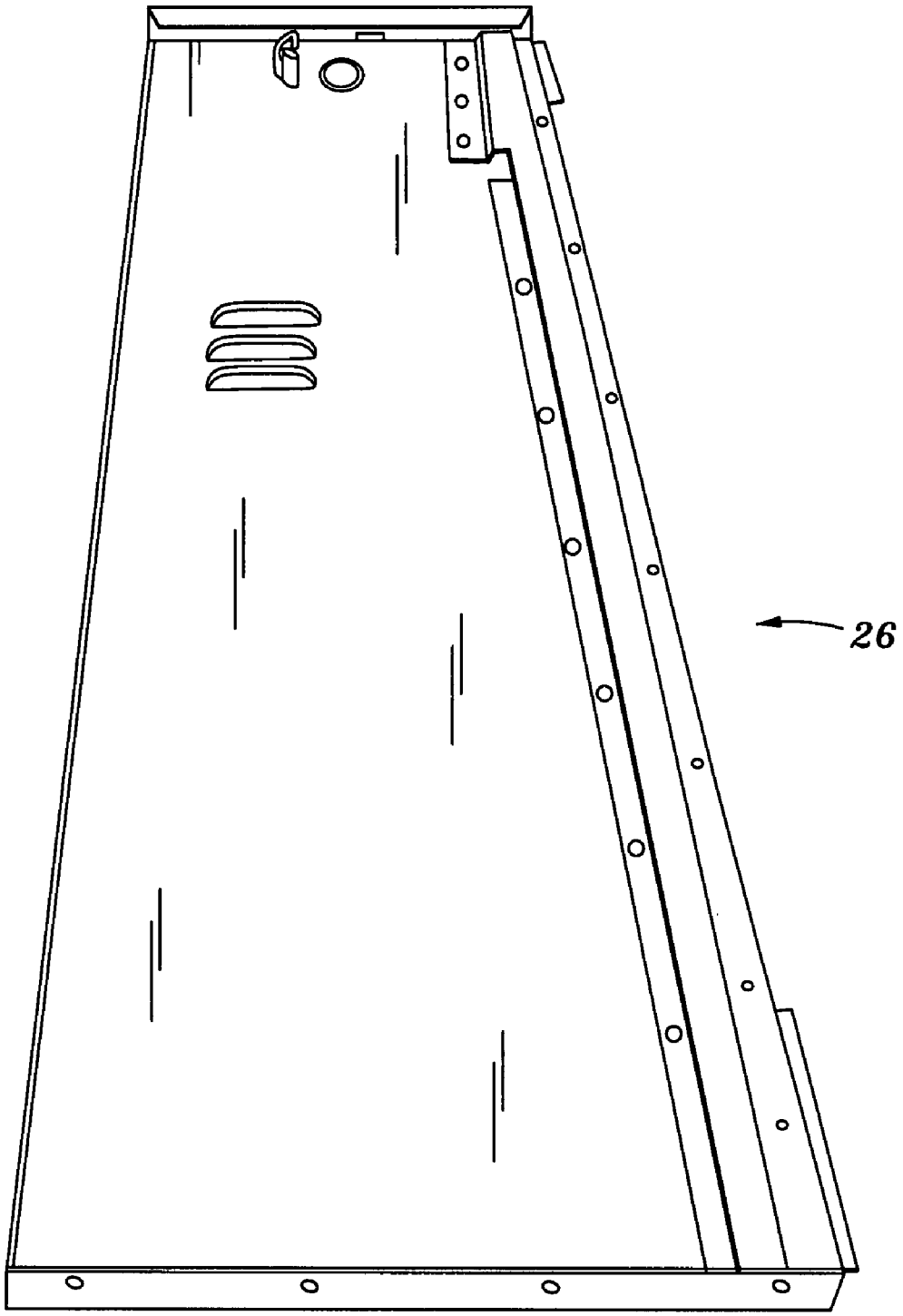
FIG. 4 illustrates a right side of the modular gaming cabinet illustrated in FIG. 1.
Figure 5:
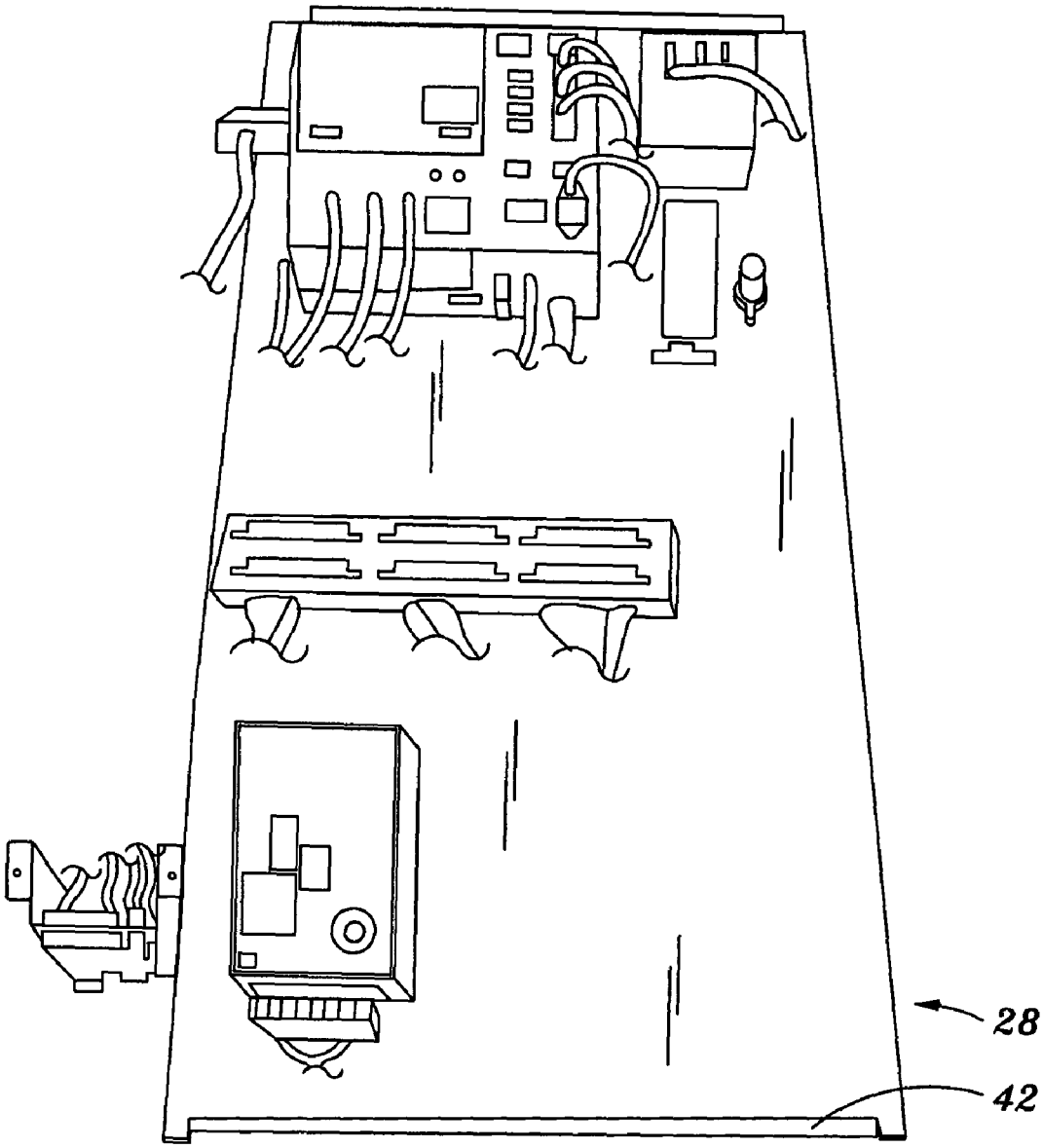
FIG. 5 illustrates a back of the modular gaming cabinet illustrated in FIG. 1.
Figure 6:
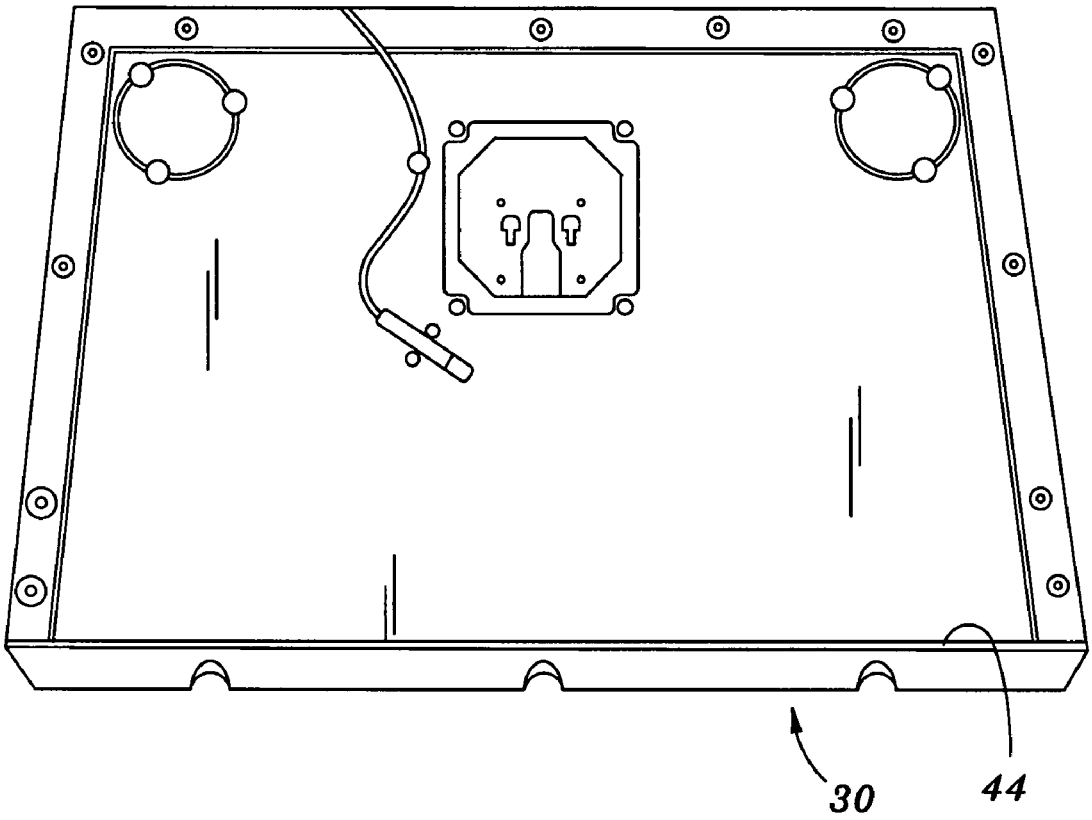
FIG. 6 illustrates a top of the modular gaming cabinet illustrated in FIG. 1.
Figure 7:
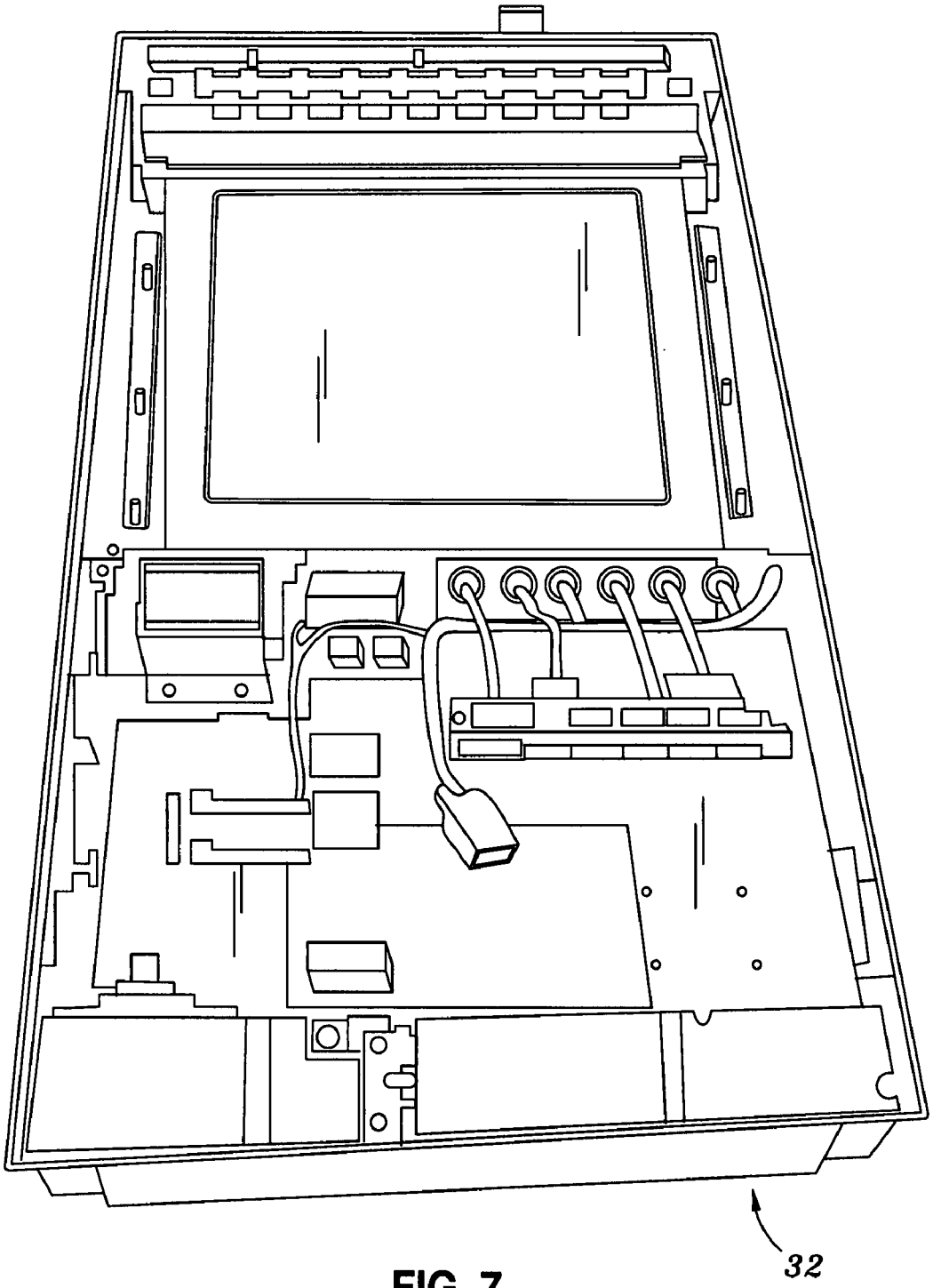
FIG. 7 illustrates a door of the modular gaming cabinet illustrated in FIG. 1.

In one embodiment, the gaming cabinet 20 is constructed from a base 22 (as illustrated in FIG. 2), a first or left side 24 (as illustrated in FIG. 3), a second or right side 26 (as illustrated in FIG. 4), a back 28 (as illustrated in FIG. 5), a top 30 (as illustrated in FIG. 6), and a front or door 32 (as illustrated in FIG. 7). When connected, these components or portions define a generally enclosed cabinet 20 having an interior space for housing various components. Access to the interior is provided through the door 32, which may be moved between open and closed positions.

In a preferred embodiment, referring to FIG. 2, the base 22 has an inner surface, an outer surface and a peripheral edge. In one embodiment, the base 22 is generally square, and thus has four edges. In a preferred embodiment, the outer or bottom surface of the base 22 is positioned on a support or platform which is smaller in dimension than the base 22, whereby the edges of the base 22 extend beyond the edge(s) of the support. The support may be, for example, a generally square piece of plywood about 0.5 inches thick. As detailed below, in this configuration, when the sides 24, 26 and back 28 of the cabinet 20 are connected to the base 22, they are elevated. In this manner, when the gaming cabinet 20 is placed on a support surface, such as a gaming machine stand, the sides 24,26 and back 28 do not contact the support surface. Instead, the support is the only point of contact between the cabinet 20 and the support surface. As such, the gaming cabinet 20 remains perfectly "square" because the sides 24, 26 and/or back 28 are not at different elevations relative to one another (but instead are all connected to the base 22).

In one embodiment, the base 22 has an upstanding flange 34 or lip at opposing front 36 and rear 38 portions thereof at the inner surface thereof. These flanges 34 are for use in connecting mating portions of other portions of the cabinet 20. Preferably, the two opposing side edges are generally flat.

Referring to FIG. 3, the left side 24 has an inner surface and an opposing outer surface and a peripheral edge. In one embodiment, the edge defines a bottom, a top, a front edge and a rear edge. As illustrated, the width of the side decreases from its bottom towards its top edge, the front edge sloping towards the rear edge. In one embodiment, at least one flange or lip 40 extends inwardly from the inner surface of the left side 24 of the cabinet 20. As illustrated, the flange 40 extends inwardly from all four edges.

Referring to FIG. 4, the right side 26 is similar in configuration to the left side 24.

Referring to FIG. 5, the back 28 has an inner surface, an opposing outer surface and a peripheral edge. As illustrated, the back 28 is generally rectangular in shape, having a top edge, bottom edge and a pair of side edges. In one embodiment, the back 28 has a flange 42 which extends inwardly from the inner surface at the top and bottom edges thereof. Preferably, the two opposing side edges are generally flat.

Referring to FIG. 6, the top 30 has an inner surface and an opposing outer surface and a peripheral edge. In one embodiment, the top 30 is generally square, having four edges. In one embodiment, a flange 44 extends outwardly from the inner surface of the top 30 at a front edge thereof. The remaining edges are preferably flat.

Referring to FIG. 7, the door 32 has an inside and an outside. In one embodiment, the door 32 is generally rectangular in shape and has a top edge, bottom edge and a pair of sides or side edges. The door 32 may have a variety of configurations. In one embodiment, the door 32 is configured to be hingedly connected to one of the sides 24, 26 along one side edge of the door. As illustrated, the door 32 defines an opening at which a display may be positioned for viewing, such as in the manner described in U.S. Pat. No. 6,860,814, which is incorporated herein by reference in its entirety.

Preferably, as illustrated, a plurality of apertures and slots are defined in the components of the cabinet 20, including the flanges thereof. In addition, a variety of studs may be connected to the various components and extend therefrom for use in connecting the components.

In a preferred embodiment, the base 22, sides 24,26, back 28, top 30 and door 32 are constructed of metal. The outside of each of those components may be painted, plated or the like, such as in a powder coat process in order to protect those components and improve the aesthetic appearance thereof.

A method of assembling the components into the cabinet 20 is illustrated in FIGS. 8-20. As illustrated therein, the sides 24, 26 and back 28 are connected to the base 22, the sides 22, 24 and top 30 are connected to the back 28, the sides 24, 26 and back 28 are connected to the top 30, and the door 32 is connected to the left side 24. Preferably, flat edge portions of the components are mated with the outwardly extending flanges of mating components, whereby portions of the components overlap one another to form points of connection.

In a preferred embodiment, fasteners engage the components of the cabinet 20. In one embodiment, somewhat elongate slots are formed in the edges of the components (or flanges thereof) between opposing edges, while closely toleranced holes are formed at the terminus of the edges. In this manner, when two components are aligned for connection, the peripheral portions of each component are closely aligned, while the central portions thereof have slots which permit some offset while still accepting a fastener there through.

In some instances, studs extending from one component extend through the mating slots/holes in the mating component. In other instances, bolts and mating nuts (or other threaded fasteners) are utilized. Importantly, in this configuration, "metal to metal" contact between the components is ensured. For example, compared to riveting, where the rivet may "float" in an opening and not make constant and direct contact with the associated panel, the use of the studs or bolts and mating nuts ensures that metal to metal contact is guaranteed between the components.

In a preferred embodiment, threaded studs or bolts and mating nuts are utilized to form the connections between the components. In this manner, the components of the gaming cabinet 20 can be shipped to an end user who can then assemble the cabinet 20 using only basic tools (i.e. without the need for special tools or special manufacturing equipment). It will additionally be appreciated that use of such fasteners, as compared to rivets, welding and the like, permits the cabinet 20 to be selectively disassembled. For example, a damaged side may be replaced by disconnecting it from the remaining components of the cabinet. Another advantage of this configuration is, unlike rivets, that no part of the fasteners need to be visible or accessible from the exterior of the cabinet (when studs are used, their heads are embedded, and when bolts or screws are used, they may pass through a flange rather than from the outer to the inner side of one the panel/component). This ensures that the fasteners are not tampered with and makes the cabinet more aesthetically pleasing.

Figure 21:
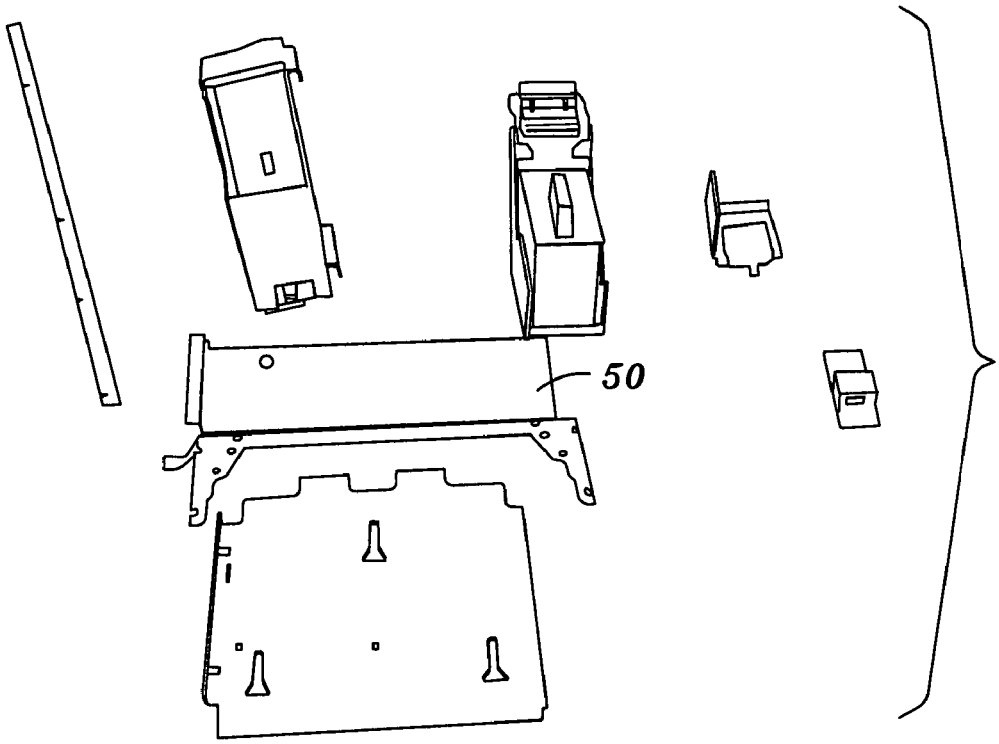
FIG. 21 illustrates additional components of the gaming machine illustrated in FIG. 1.

In one embodiment, as illustrated in FIG. 21, the cabinet 20 may include a number of additional features or components. These components do not form a portion of the "enclosure" per se, but may form a portion of the final cabinet 20. For example, referring to FIGS. 10 and 21, the cabinet 20 may include a stiffener 50. As illustrated, the stiffener 50 may be configured to be located at the interior of the cabinet 20 and be connected to the sides 24, 26 and top 30. Location of the stiffener 50 near the front of the cabinet 20 aids in maintaining the cabinet 20 square and adds rigidity thereto (which is otherwise lessened at the front because the door 32 when in the open position does not connect to both sides 24, 26).

In a preferred embodiment, the gaming cabinet 20 includes wiring and other gaming machine presentation components. In a preferred embodiment, the cabinet 20 comprises part of a universal presentation platform which is configured to accept one of many different gaming devices and which, when a gaming device is associated therewith, is configured to present one or more games.

In a preferred embodiment, the wiring and other components are primarily associated with the components of the cabinet 20 (rather than by being separate therefrom). In one embodiment, player input buttons (including lamps and switches), one or more meters, one or more speakers, a coin head, a coin acceptor, a coin diverter controller (such as a solenoid), one or more displays (including main, secondary, progressive/bonusing/player tracking and other displays), a belly light, award or top light and door switch, may be connected to the door 32. In one embodiment, a universal power distribution box, belly light ballast, one or more connector panels, power supply and gaming device connectors (described below), may be connected to the back 28. One or more key switches are mounted to the right side 26. An awards or top light ballast, exhaust fan and main door switch may be mounted to the left side 24. A hopper/printer connector and coin hopper may be mounted to the base 22. A service light may be mounted to the top 30. Of course, different and/or additional components may be mounted to the cabinet panels/components.

The gaming cabinet 20 preferably includes means for displaying game information to a player. Though not illustrated in FIG. 1, such means might comprise rotatable reels or, in a preferred embodiment, a video display. In one embodiment, referring to FIG. 20, at least one video display is associated with the door, such as for viewing at a window thereof in the manner described in U.S. Pat. No. 6,860,814.

In a preferred embodiment, the various electrically operated components of the cabinet/platform 20 are arranged to be "stand-alone" so that they may be independently tested. For example, the player input buttons are configured so they may be directly tested in place on the door while the door is still disconnected from the remaining components of the cabinet 20 (i.e. before the cabinet is assembled). Similarly, the various connectors/harnesses associated with the back 28 may be tested and checked independently of the other features/components, such as those associated with the door. This configuration has the particular advantage that the components of the cabinet 20 can be tested before they are shipped and without having to assemble the cabinet 20, thus saving substantial time but still ensuring that the components will work once the cabinet 20 is assembled.

Preferably, connectors are provided relative to the electrical components mounted to the cabinet portions. For example, one or more connectors are provided relative to the display, player input buttons and coin acceptor associated with the door 32 for connection to the main connectors mounted to the back 28, whereby these components may be connected to one another when the cabinet 20 is assembled. In one embodiment, the connectors may be male/female type electrical connectors or plugs, such as multi-pin connectors. The connectors may be located at the ends of wiring runs, and those wiring runs may then be extended and plugged into one another during cabinet assembly. In another embodiment, the connectors could be mounted in stationary locations which, when mating portions of the cabinet 20 are connected, cause the connectors to be connected (for example, one connector could be located at the rear portion of the left side 24 for mating with a similarly positioned connector at the back 28, when the left side 24 and back 28 are joined. As described below, the wiring preferably leads to a universal gaming device interface which is configured to mate or connect a gaming device, whereby the gaming device may interface with those components.

In one embodiment, the configuration of the modular cabinet 20 can easily be changed. For example, in one configuration, the cabinet 20 may have a depth of 18 inches. Using the same back 28 and door 32, but deeper sides 24, 26, base 22 and top 30, the cabinet 20 may have a depth of 22 inches. Of course, the particular dimensions given are by way of example and other cabinet sizes are contemplated.

Preferably, the configuration of the electrical components is substantially the same or "standardized" relative to each and every cabinet 20. For example, wiring harnesses are preferably all of the same length, regardless of the size of the cabinet 20. Preferably, the wiring harnesses are all the longest length necessary for the largest cabinet size. When used in smaller cabinets, the wiring may be doubled back or folded to fit the smaller cabinet. In this manner, only one configuration of each of the components, including wiring sets or harnesses, needs to be configured for multiple configurations of completed cabinets 20.

Figure 22A:
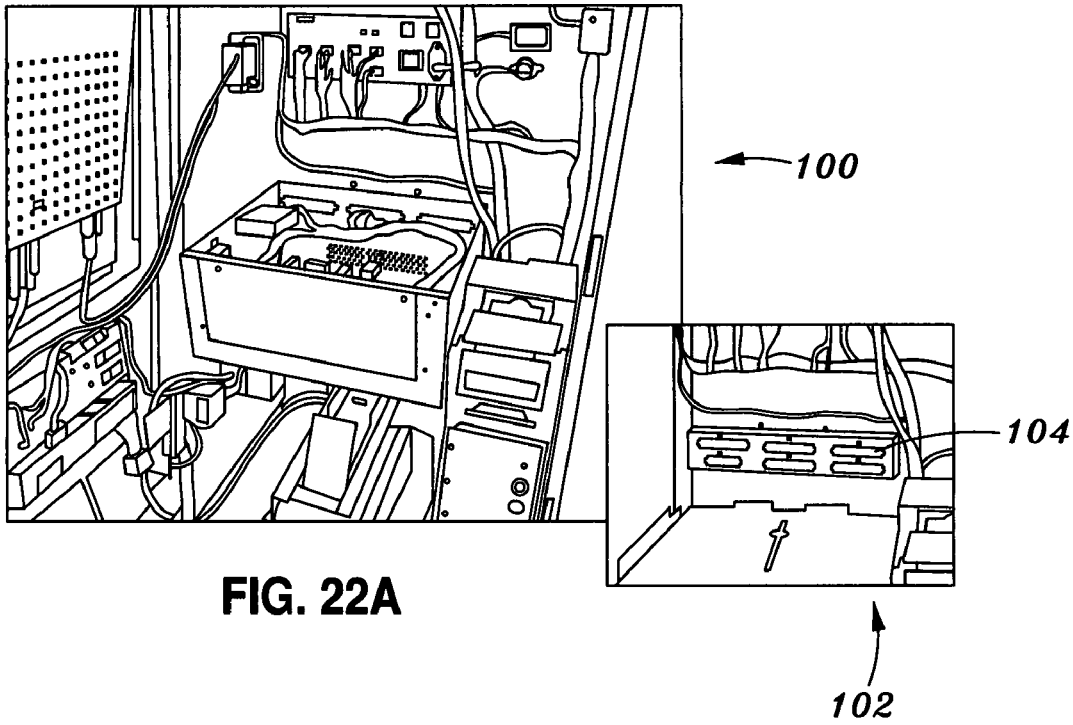
FIG. 22 illustrates a gaming device and the universal presentation platform of the gaming machine illustrated in FIG. 1.
Figure 22B:
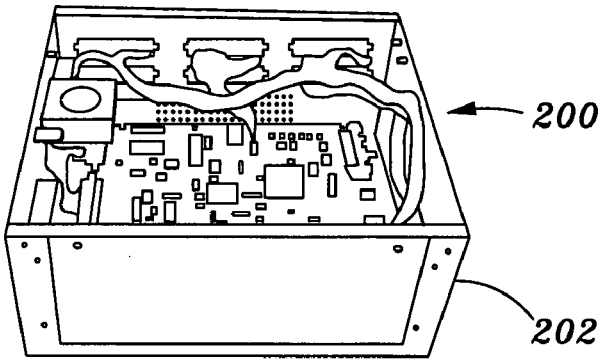

As indicated, in a preferred embodiment, the modular cabinet 20 comprises a portion of a universal presentation platform. Referring to FIG. 22, the universal presentation platform 100 is configured to accept a gaming device 200 (described in more detail below). The universal presentation platform 100 preferably includes a universal gaming device interface (UGDI) 102. The UGDI 102 comprises a standardized connection or mount for a docking or mating with different gaming devices 200.

In the embodiment illustrated, the UGDI 102 comprises a plurality of ports 104 for connection to one or more connectors of a gaming device 200. The ports 104 are connected to wires (or other elements for transmitting signals, such as leads, optical fiber or the like) leading to various components of the platform 100. The ports 104 may be arranged in various fashions. In one embodiment, the ports 104 are associated with the back 28 of the cabinet 20. A gaming device platform may be located in the cabinet 20 for supporting the gaming device 200 when mated or connected to the ports 104.

Figure 23:
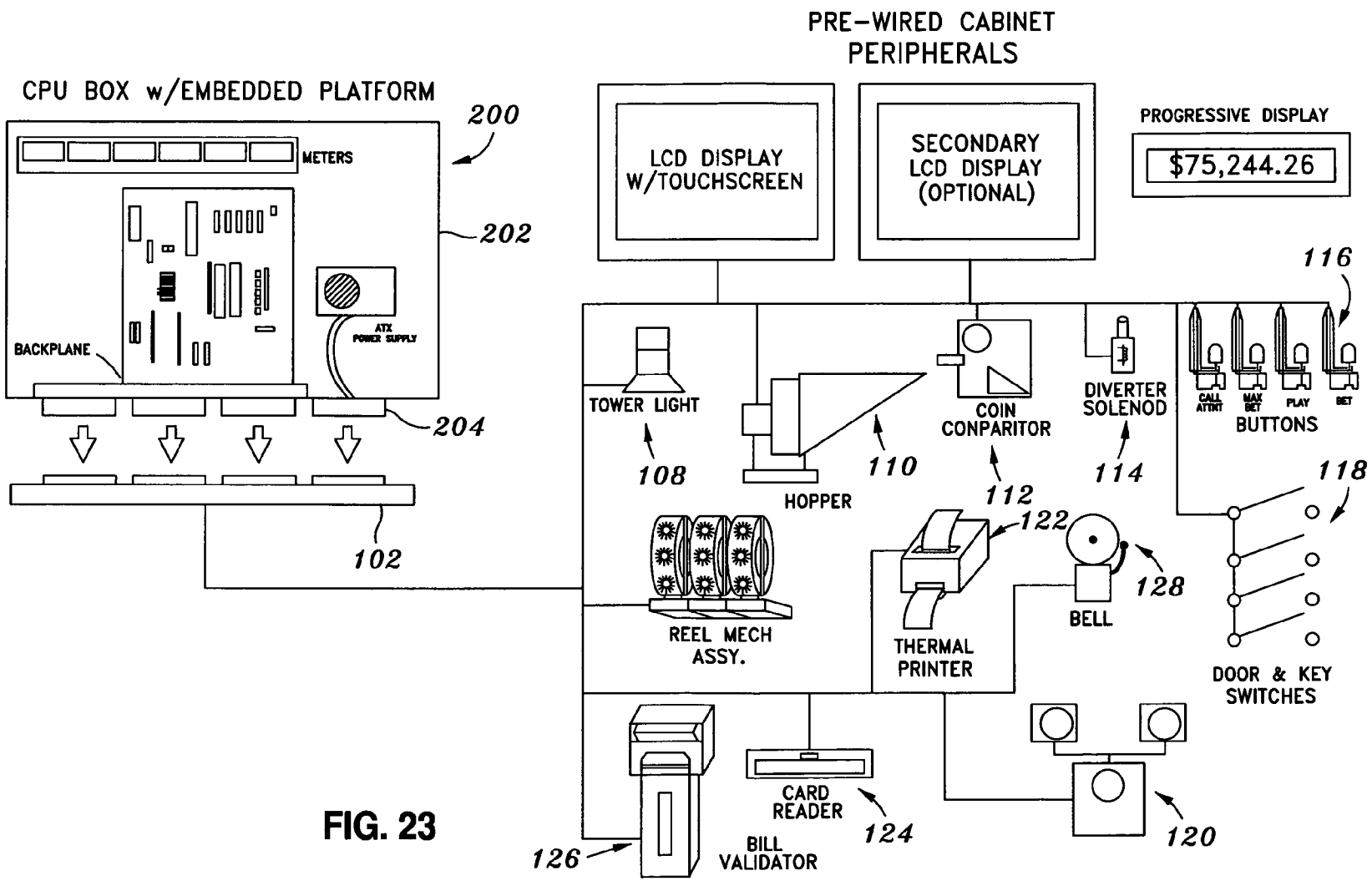
FIG. 23 illustrates one embodiment of a gaming device of the invention, a universal gaming device interface and other components of a universal presentation platform of the gaming machine in accordance with the present invention.
Figure 24:
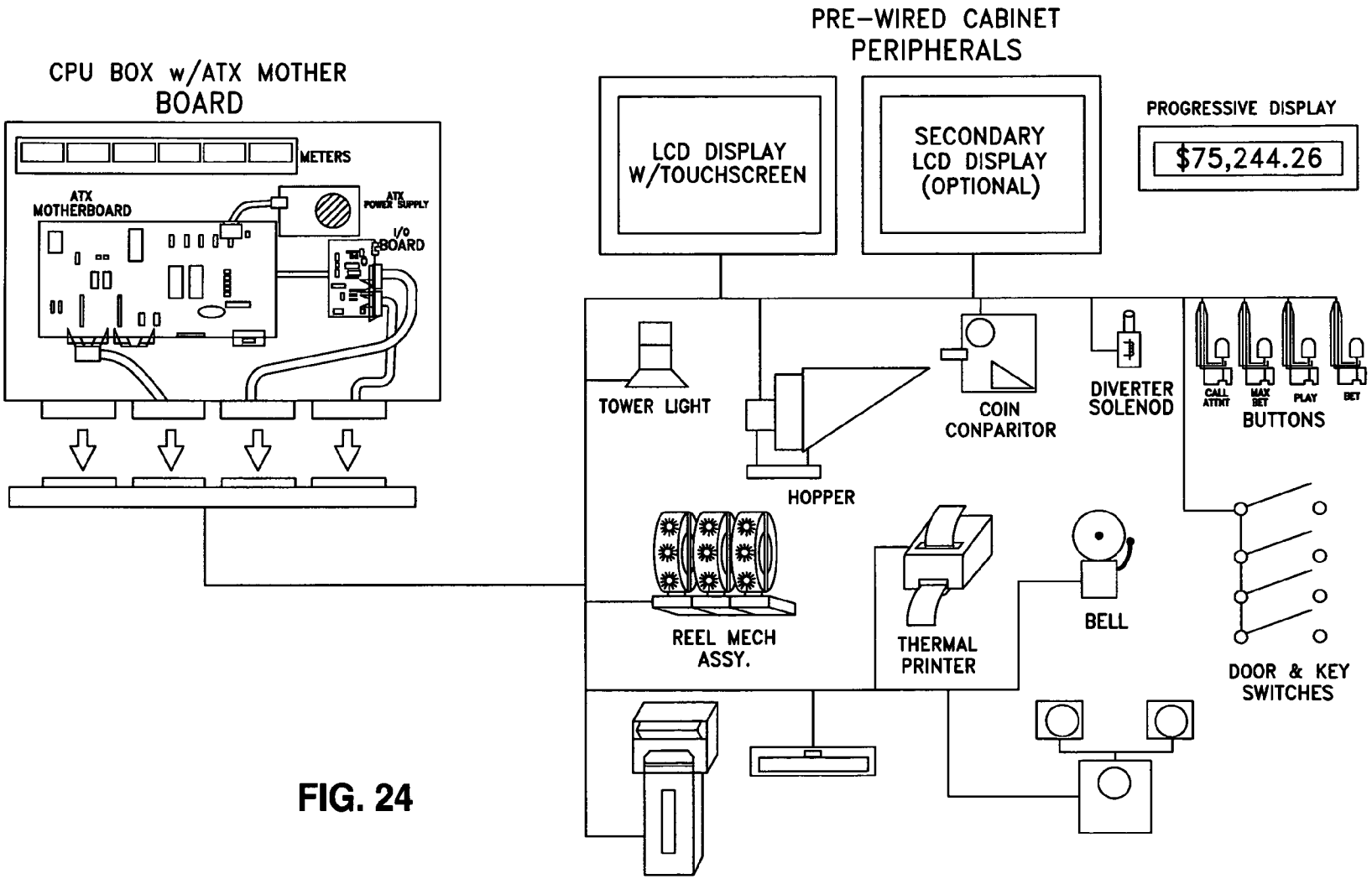
FIG. 24 illustrates another embodiment of a gaming device of the invention, a universal gaming device interface and other components of a universal presentation platform of the gaming machine in accordance with the present invention.
Figure 25:
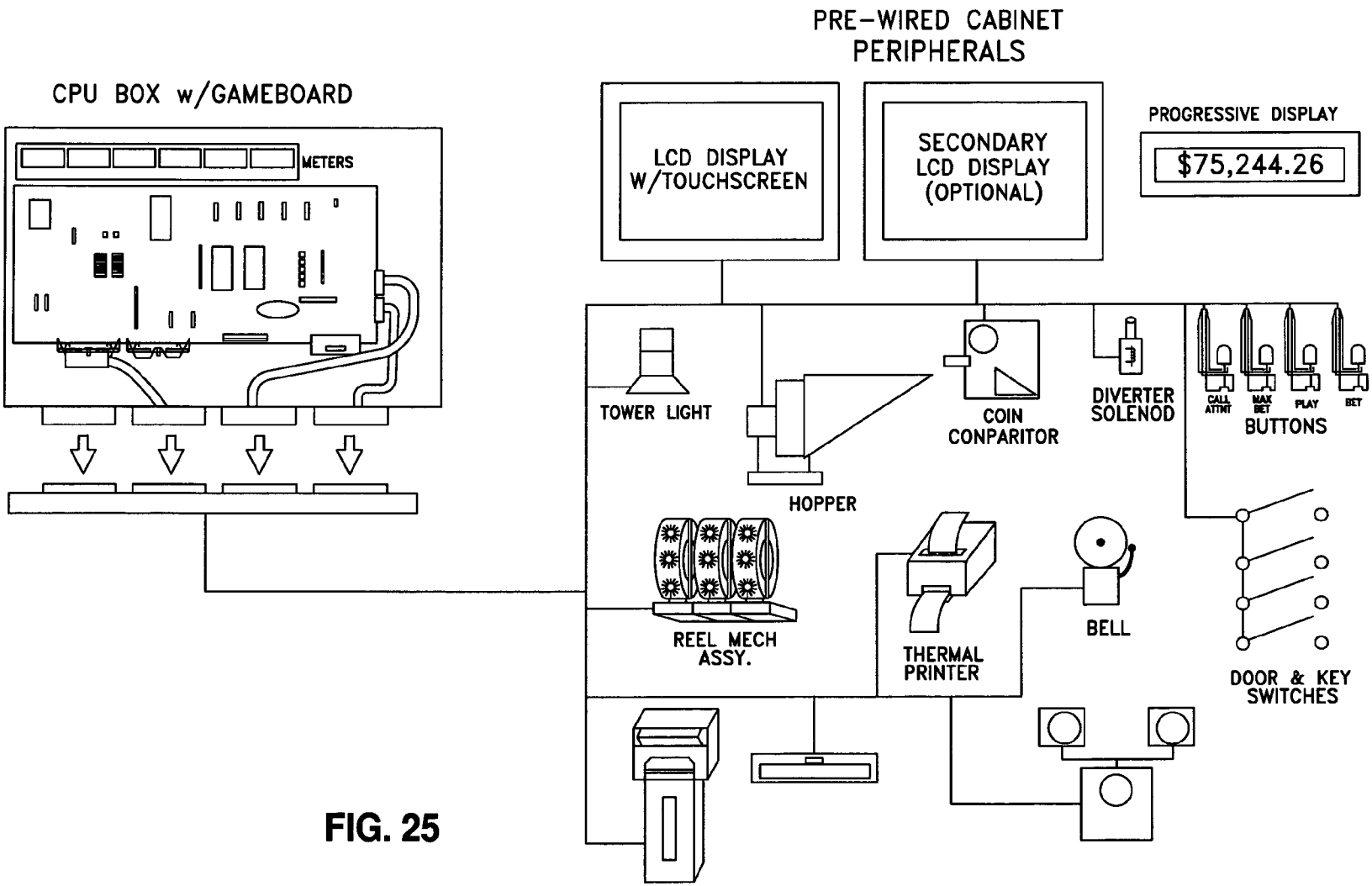
FIG. 25 illustrates yet another embodiment of a gaming device of the invention, a universal gaming device interface and other components of a universal presentation platform of the gaming machine in accordance with the present invention.
Figure 26:
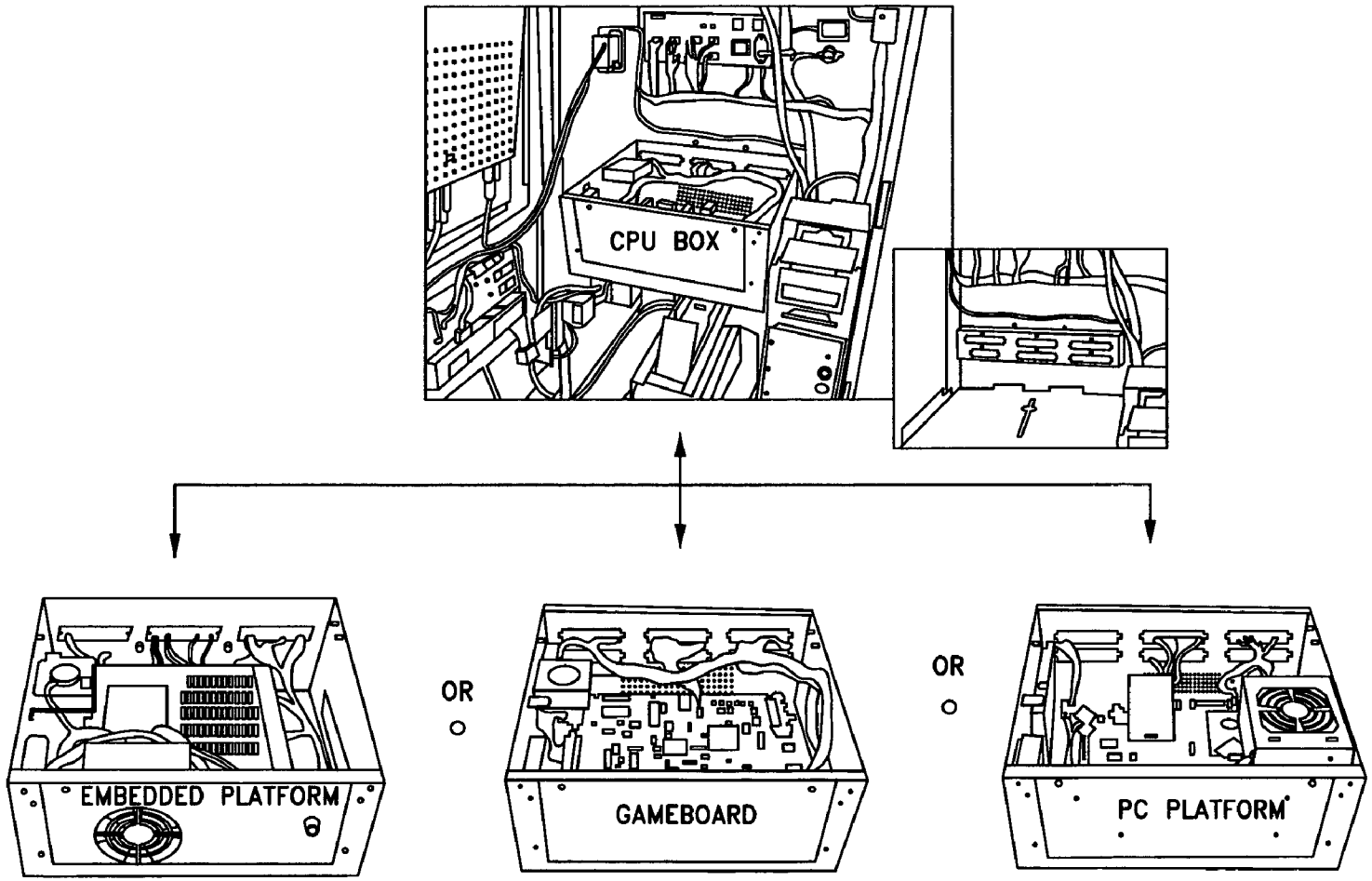
FIG. 26 illustrates the universal presentation platform of the invention configured to accept different gaming devices.

FIGS. 23-25 illustrate a particular configuration of electronics of a platform 100. As illustrated, the platform 100 includes the UGDI 102 wired or otherwise in electrical/control communication with various components. In one embodiment, these components include one or more video or other displays 106 (such as LCD, plasma, CRT or other video displays, or reels or other means for presenting information), a tower light 108, a coin hopper 110, a coin comparitor 112, a diverter 114, one or more player input buttons 116, one or more door or key switches/locks or controls 118, one or more speakers 120, a printer 122, a card reader 124, bill validator 126, and a bell 128. Of course, the platform 100 could be configured to not include various of those components or to include other or additional components. In a preferred embodiment, the components which are necessary for presenting a variety of different games are all included so that the configuration of the platform 100 is generic or standard and is not changed even when the platform 100 is mated with different gaming devices 200 for presenting different games (for example, the platform 100 preferably includes wiring leading from the UGDI 102 for connection to a coin hopper, though the coin hopper may not be used in all instances).

Another aspect of the invention is a gaming device 200. Referring to FIG. 22, in a preferred embodiment, the gaming device 200 includes a housing 202. The gaming device 200 is, as detailed below, configured to be located within the interior of a gaming cabinet 20. In general, the gaming device 200 controls the various components of the platform 100, by providing output to or receiving input from those components, for presenting a game. Preferably, without the gaming device 200, the presentation platform 100 is not operable and can not present a game. On the other hand, with one or more input and output devices, the gaming device 200 is preferably capable of presenting a game.

In one embodiment, the housing 202 is a generally enclosed box or other enclosure. As illustrated, a top or other portion of the housing 202 may be opened or removed to provide selective access to the interior thereof. The top or other portion may be secured with one or more locks, such as a purely mechanical key-operated lock or an electro mechanical lock, such as a card-reader type lock.

Preferably, the gaming device 200 includes a controller configured to generate and/or provide game data. This data may include game data or information which is presented to the player via a display, such as video information. The data may also include control instructions or commands for operating various of the components of the platform 100. The gaming device 200 also preferably includes other verification, security and/or control components. For example, as detailed below, the gaming device 200 may include one or more meters, a player tracking controller and bonusing controller. In general, the gaming device 200 preferably includes all of the components necessary to operate or run a gaming machine and which must be verified or certified, such as by appropriate gaming authorities, to ensure the gaming device 200 is secure.

The gaming device 200 may have a variety of configurations. Referring to FIG. 23, the controller of the gaming device 200 may be a computer-type configuration including a CPU. In such a configuration, the controller may comprise a motherboard having an associated memory and processor, among other components. Meters, a player tracking controller, bonusing controller or the like may be configured to communicate with the processor via a bus associated with the motherboard. The CPU may be powered by a power supply which obtains power from an outside source. Preferably, the various components of the controller are in communication with one or more connectors 204 which are configured to mate with the UGDI 102.

Referring to FIG. 24, in another embodiment, the controller of the gaming device 200 may be configured as a computer-type configuration including a CPU and input/output controller. As illustrated, the CPU may include a motherboard with embedded or associated processor, memory and the like. Various inputs and outputs may be routed through an input/output board or controller. Again, the components of the gaming device 200 are provided in communication with one or more connectors 204 which are configured to mate with the UGDI 102.

Referring to FIG. 25, in yet another embodiment, the controller of the gaming device 200 may be configured dedicated gameboard. The gameboard is preferably a particularly configured controller, such as including a particularly programmed or configured processor. Again, the components of the gaming device 200 are provided in communication with one or more connectors 204 which are configured to mate with the UGDI 102.

In one embodiment, the housing 202 of the gaming device 200 may be configured with one or more connections for securing the housing 202 to the gaming device 200. In one embodiment, one or more threaded fasteners may be passed through a wall or other portion of the housing 202 into engagement with the cabinet 20. In a preferred embodiment, the threaded fastener(s) extend from the interior of the housing 202 into selective engagement with the cabinet 20. In this manner, when the housing 202 is locked, the fasteners are no longer accessible, preventing the gaming device 200 from being removed by a party who does not have access to the interior of the housing 202 (such as by having the key to the top lock of the housing 202).

In one embodiment, the housing 202 may be provided with another or different locking mechanism. For example, the housing 202 may be configured to connect to the cabinet 20 using an external lock or connection, such as may be spring-loaded and released. Such a connection may ensure that the housing 202 remains in position and the connectors 204 remain tightly engaged with the UGDI 102 of the cabinet 20.

The gaming device 200 may include means for dissipating heat. In one embodiment, the housing 202 is provided with at least two openings, one of which may serve as an inlet and one as an outlet for air. The inlet may be, for example, a plurality of small holes located in a side or the top of the housing. In a preferred embodiment, the outlet comprises one or more openings leading to an outlet through the cabinet 20.

In a preferred embodiment, the cabinet 20 has a primary and a secondary venting or cooling path. The primary venting path preferably leads from one or more inlets at a lower portion of the cabinet 20 (such as through openings in a lower portion of the door 32) to one or more outlets located at a higher portion of the cabinet 20, such as exhaust vents at a top portion of one of the sides (see FIGS. 3 and 4) or the top 30, whereby air flows through the interior of the cabinet 20 from a lower to a higher portion thereof. As illustrated in FIG. 3, one or more fans may be utilized to move air along this flow path.

In addition, the cabinet 20 preferably includes a side vent which communicates with the gaming device 200. In one embodiment, the side vent comprises one or more openings in one of the sides 24, 26. Preferably, a plenum leads from the inner surface of the side 24, 26 from that outlet or vent to the one or more outlets or vents in the housing 202 of the gaming device 200 (when a gaming device 200 is associated with the platform 100). A fan or other means may be utilized, as illustrated in FIG. 22, to move air from the inlet to the housing 202 through the housing 202 to the outlet, and thereafter through the plenum to the point of exhaust from the cabinet 200.

The cabinet 20 and/or gaming device 200 may include one or more temperature sensors. The sensor may include an integrated memory for storing temperature and time data, or may be configured to output such information to the controller of the gaming device or a remote location. In one embodiment, the temperature sensor may be configured to detect or measure a temperature in the cabinet 20. The temperature sensor may include more than one sensor (for example, a sensor or sensor controller with one or more probes), such as including sensors for detecting or measuring the temperature of multiple components or areas. For example, temperature sensors may detect the temperature of the cabinet interior, gaming device housing interior, a display and/or other components or areas.

In one embodiment, when the sensed temperature exceeds a predetermined maximum temperature, the controller is configured to shut off the gaming device 200 or otherwise interrupts game play in order to avoid a game malfunction or failure. In such event, the controller may be configured to generate an alert. The alert may be displayed on the display of the platform 100 or might be sent to a central location, such as a main server, via a communication link.

In one embodiment, the cabinet 20 may include an air filtration mechanism for filtering air which is drawn into the cabinet 20. In one embodiment, a filter bracket is connected to the gaming machine at the exterior thereof at the location of the one or more air intakes to the interior of the machine. A filter is selectively located over the air intake for filtering the air which passes through the intake. Preferably, the filter is either mounted to the filter bracket or is held in place or mounted between the filter bracket and the gaming machine housing. The bracket may be configured to connect directly to portions of a vent, such as with legs which snap into slots forming the vent. In this manner, the filter can be checked and replaced without having to access the sensitive internal portions of the cabinet (which access is normally restricted). In other embodiments, a similar arrangement can be provided where the filter is located at the interior of the cabinet.

In one embodiment, the gaming machine/cabinet 20 may be configured with an automatic filter detection and replacement mechanism. In one embodiment, a filter element or elements may be configured as a roll or other continuous or connected element. Filter elements or portions may be moved from a first or "new" position to second position covering the vent(s) and then to a third or "used" position. For example, a filter roll may be configured to scroll across the vent.

In one embodiment, means may be provided for detecting a condition of the filter element or portion which is front of the vent at a particular time, to determine if it needs to be moved/replaced. For example, a light beam may be directed at the filter and, depending on the amount of light reflected back, the condition of the filter may be detected. In another embodiment, a manometer or other pressure detector may be used to detect a difference in interior/exterior air pressure (thus reflecting the "impedance" of the filter element). When the filter element or portion is detected to be "dirty," a means may be provided for moving or replacing the filter. For example, in the spool or scroll configuration, the spools may be rotated to move a portion of clean filter in front of the vent and move the dirty portion to a take-up spool.

In one embodiment, the housing 202 could be configured to be electrically isolated, such as by meeting NEMA standards, so that signals generated by the controller and other components of the gaming device 200 can not be detected externally. For example, the housing 202 may include one or more forms of shielding for such a purpose.

In one embodiment, communications between various of the components of the gaming device may be via wired connections. However, such communication links may be facilitated by wireless or a combination of wired and wireless links.

Various aspects of assembly, use and operation of a gaming device will now be described. In a preferred embodiment, a gaming device of the invention comprises a universal platform 100 and an associated gaming device 200.

The platform 100 preferably comprises a cabinet 20 and universal associated components, as detailed above. The cabinet 20 is preferably of the modular construction described above. In a method of manufacture, the individual components of the cabinet 20 are constructed. For example, the base 22, sides 24, 26, back 28, top 30 and door 32 are constructed from metal, such as in stamping procedures. As indicated, the components may be painted, plated or otherwise coated. The various additional components of the platform 100 are associated therewith. For example, the various electronics are connected to the back 28 and door 32.

In a preferred embodiment, once the electronics are associated with the particular components of the cabinet 20, those various features or elements are tested to verify their operation. The modular gaming cabinet 20 may then be shipped or transported from the manufacturer to the end user. In one embodiment, the various components are packed in one or more boxes or crates.

Figure 8A:
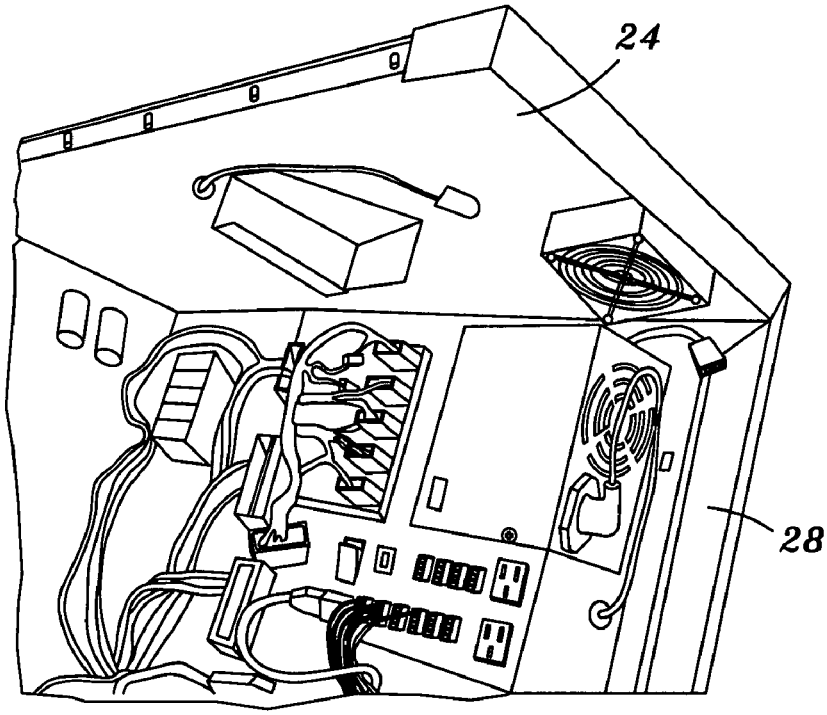
FIGS. 8-20 sequentially illustrate a method of assembling the modular gaming cabinet illustrated in FIG. 1.
Figure 8B:
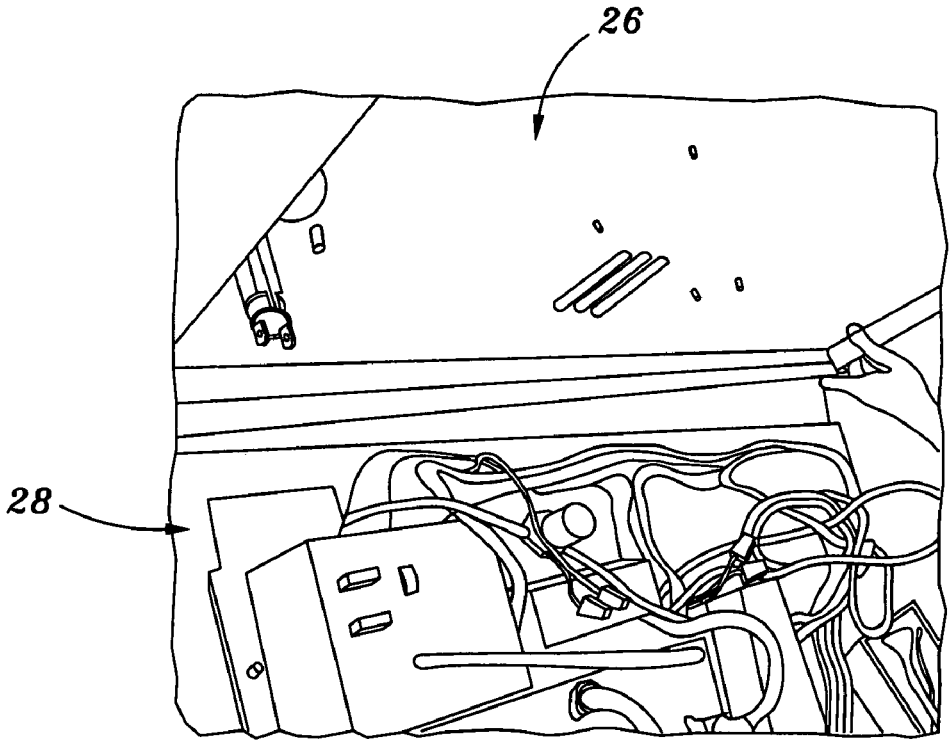
Figure 9A:
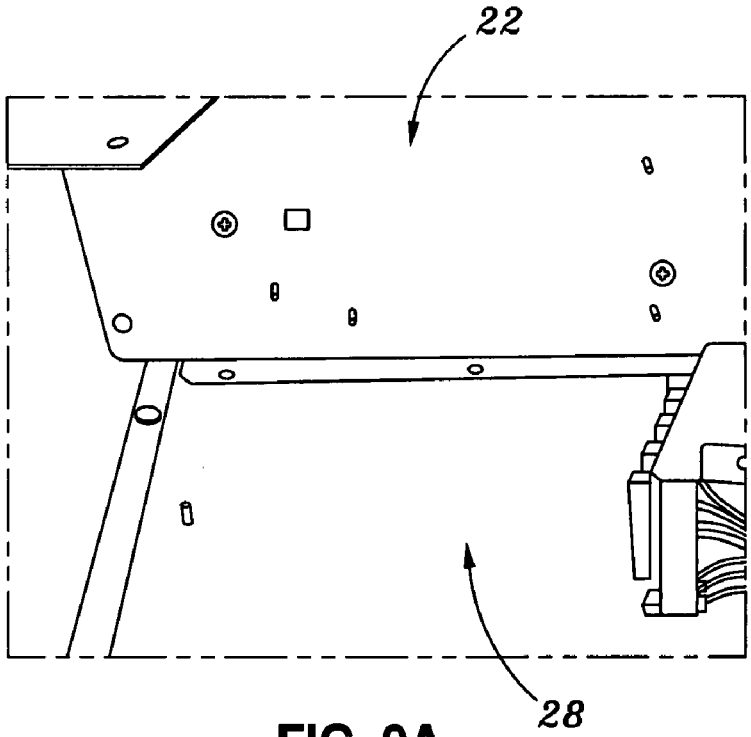
Figure 9B:
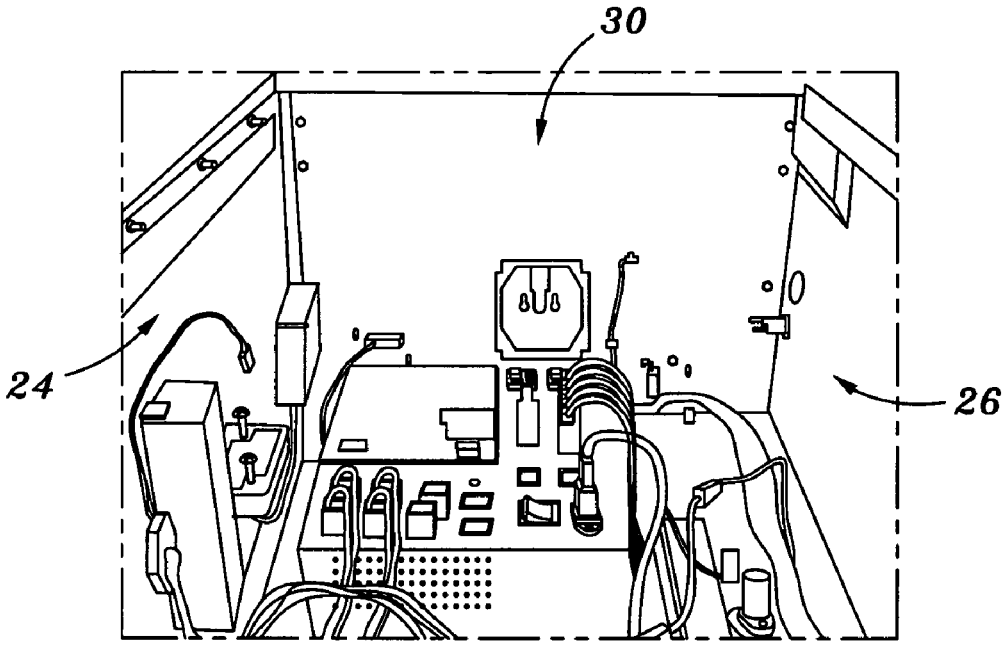
Figure 10A:
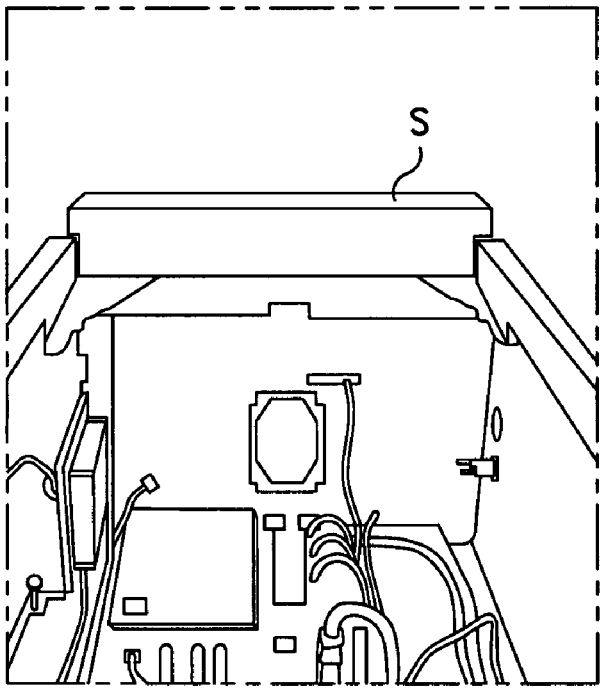
Figure 10B:
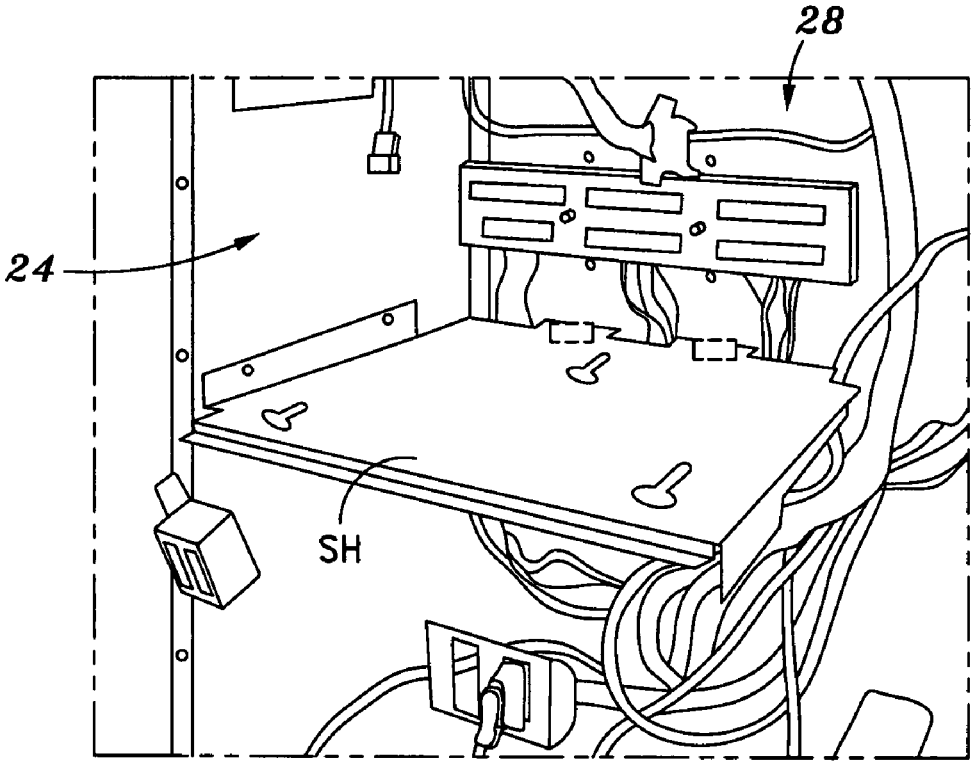
Figure 11A:
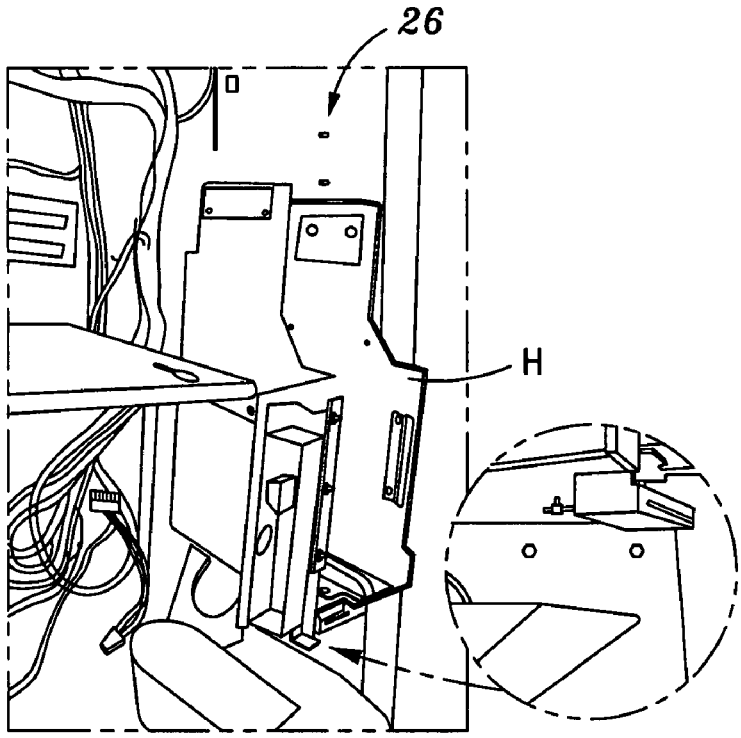
Figure 11B:
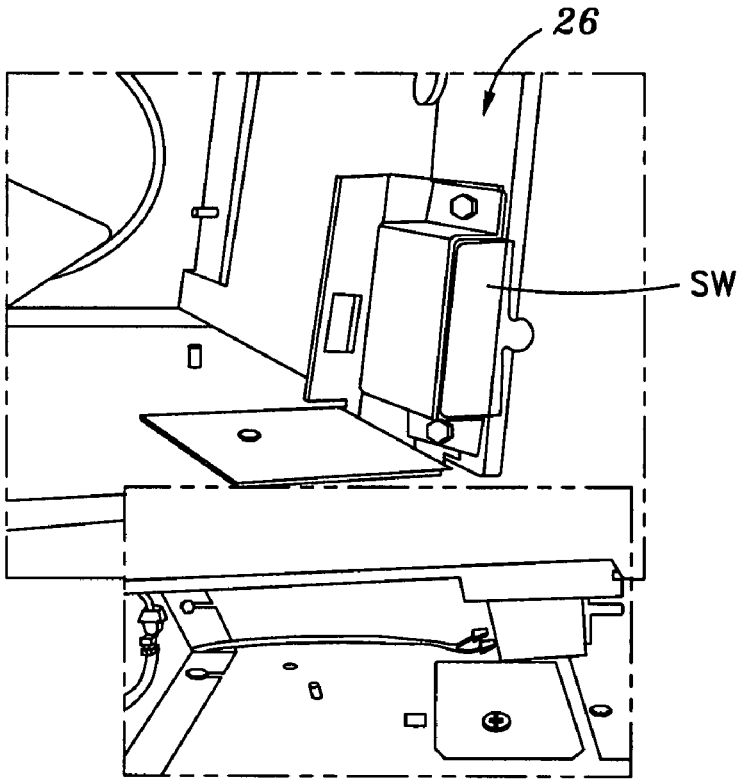
Figure 12A:
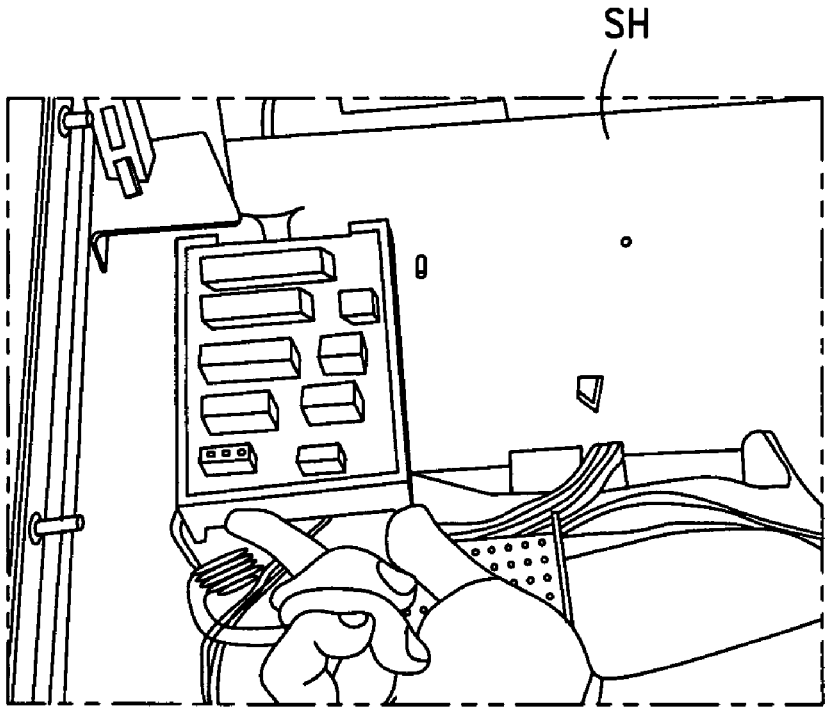
Figure 12B:
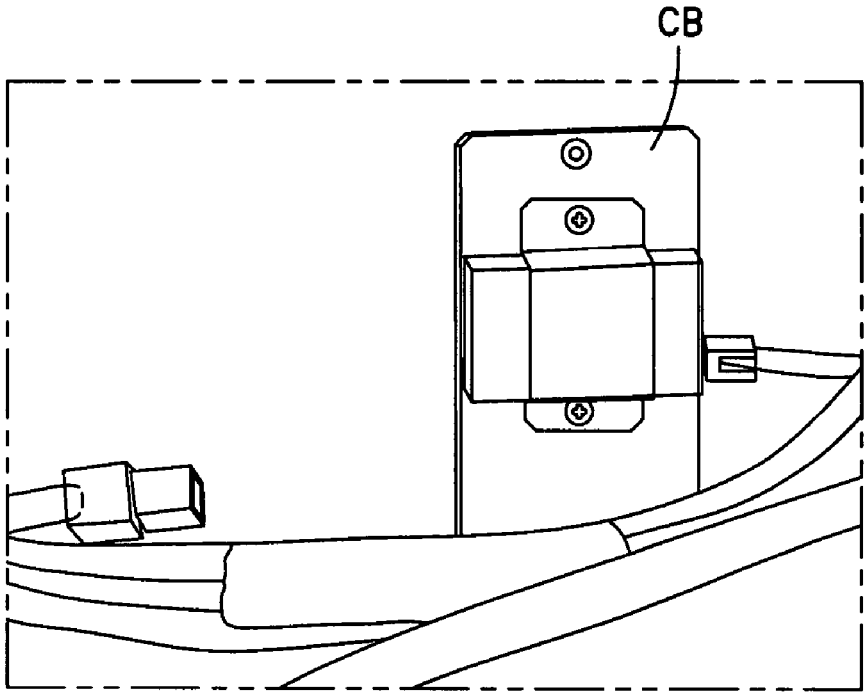
Figure 13A:
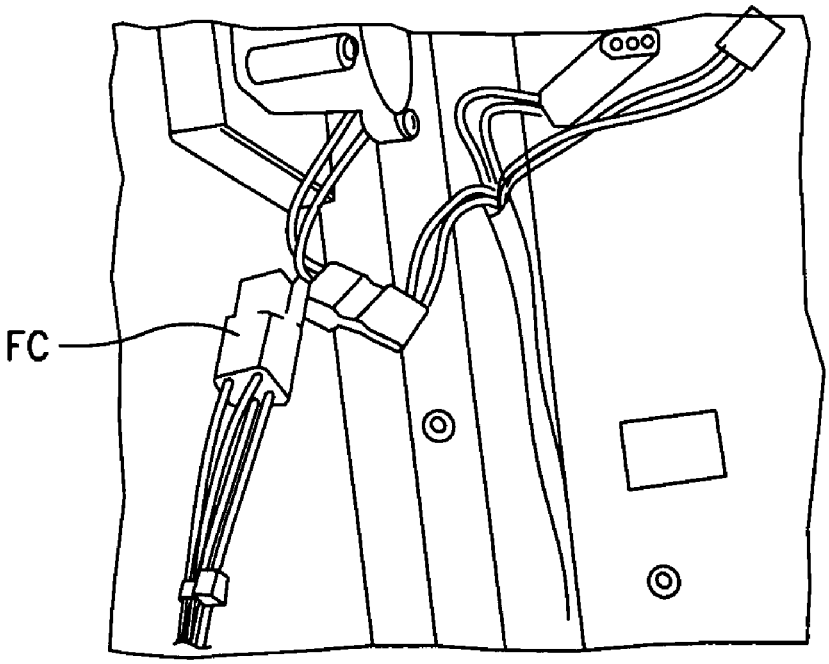
Figure 13B:
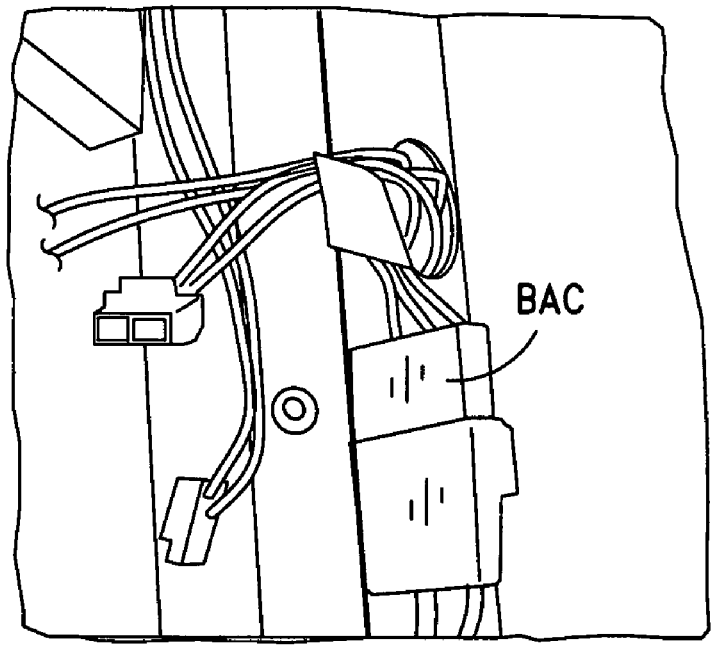
Figure 14A:
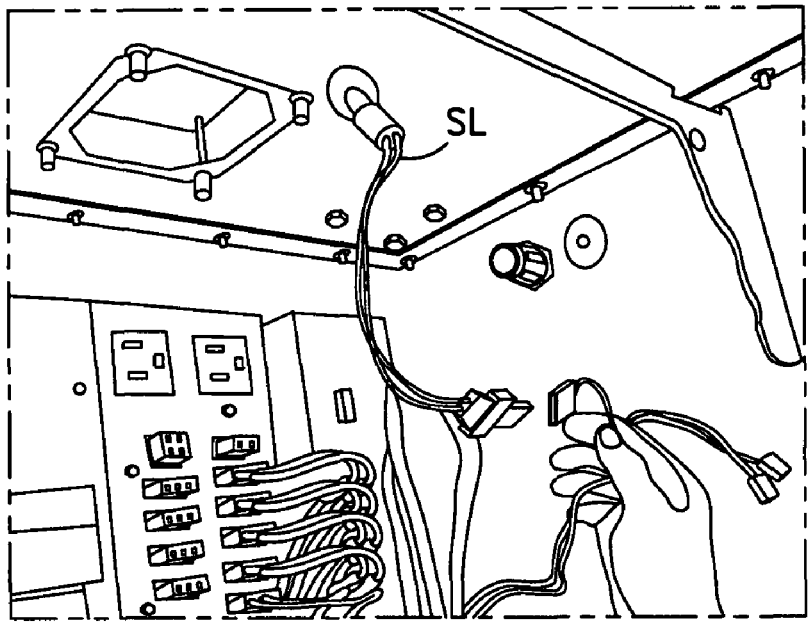
Figure 14B:
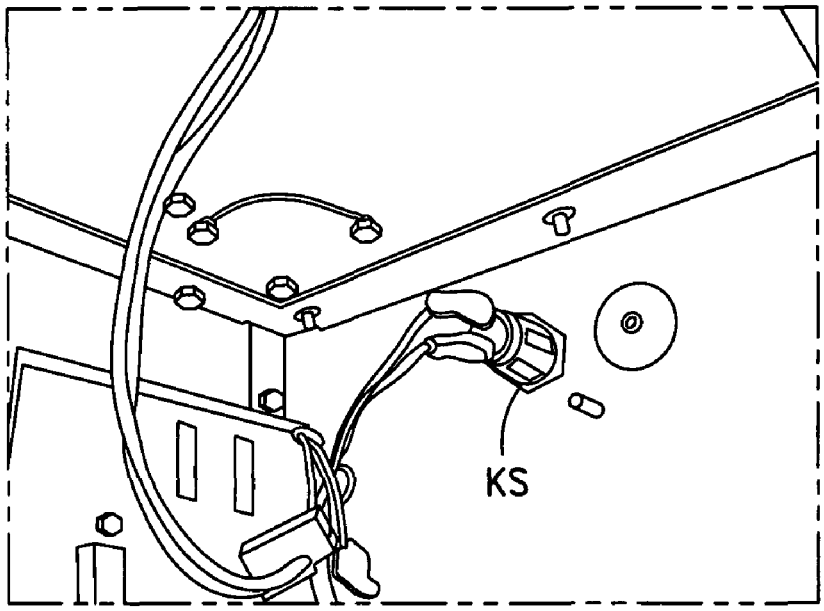
Figure 15A:
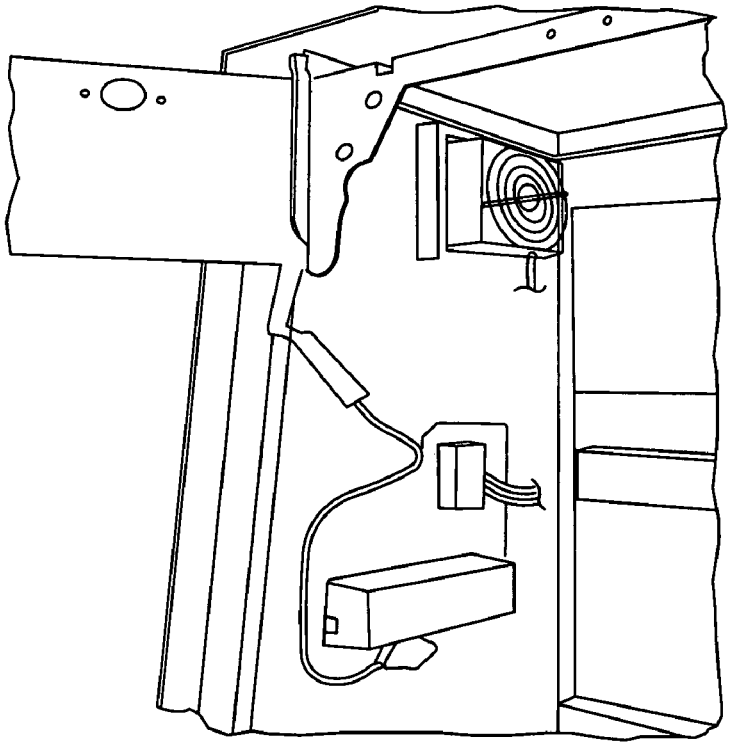
Figure 15B:
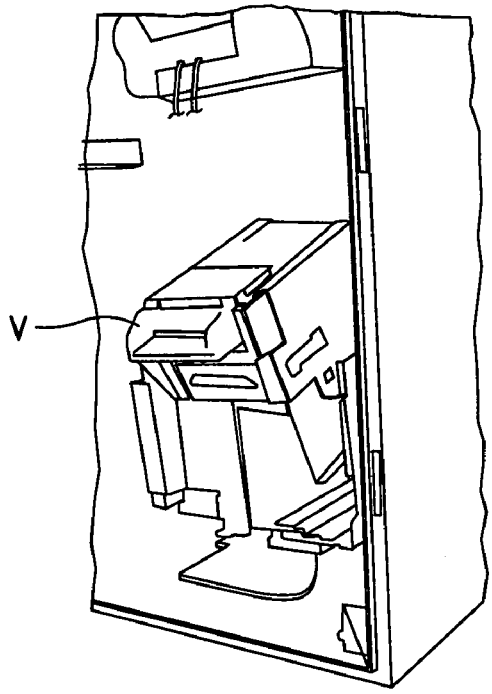
Figure 16A:
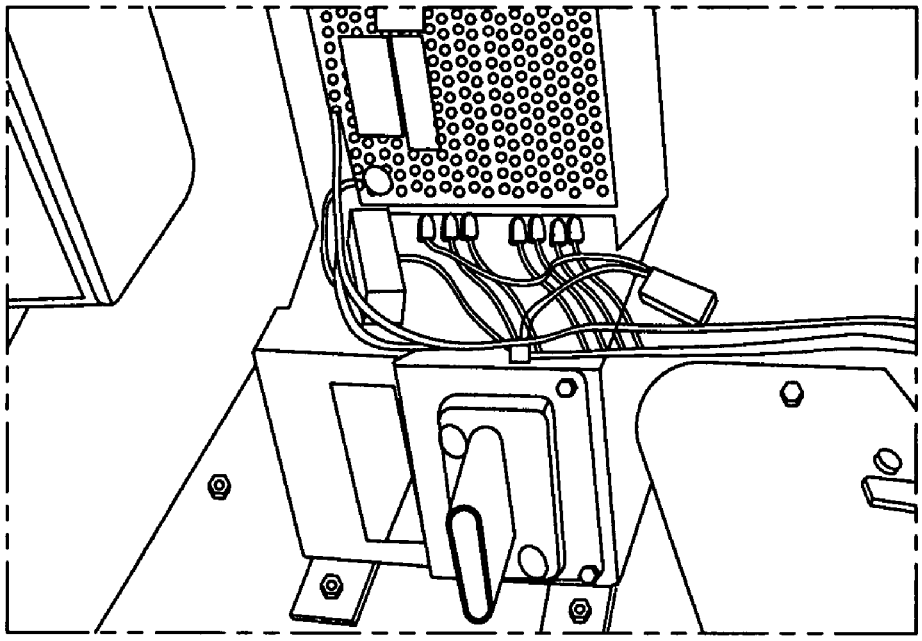
Figure 16B:
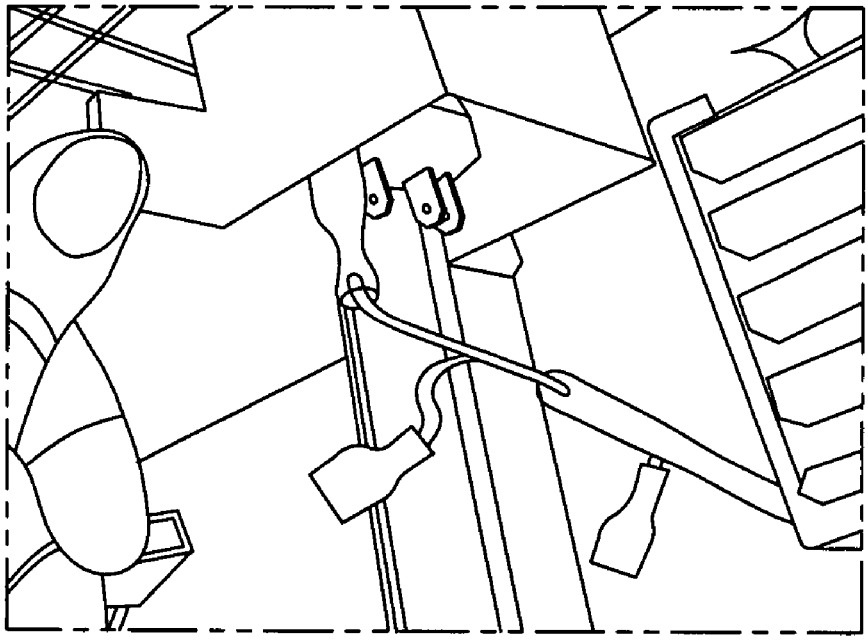
Figure 17A:
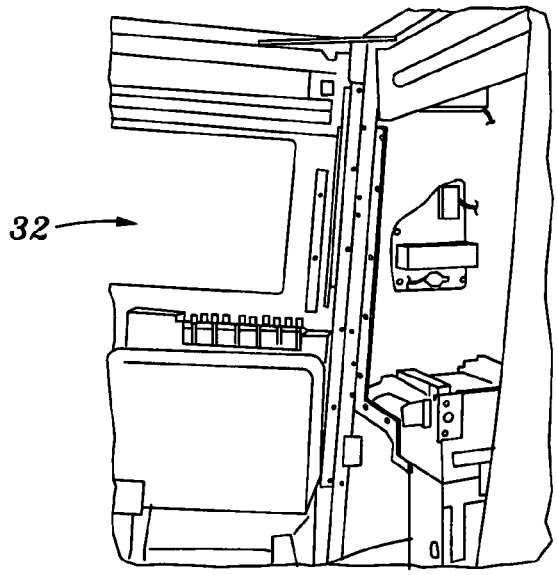
Figure 17B:
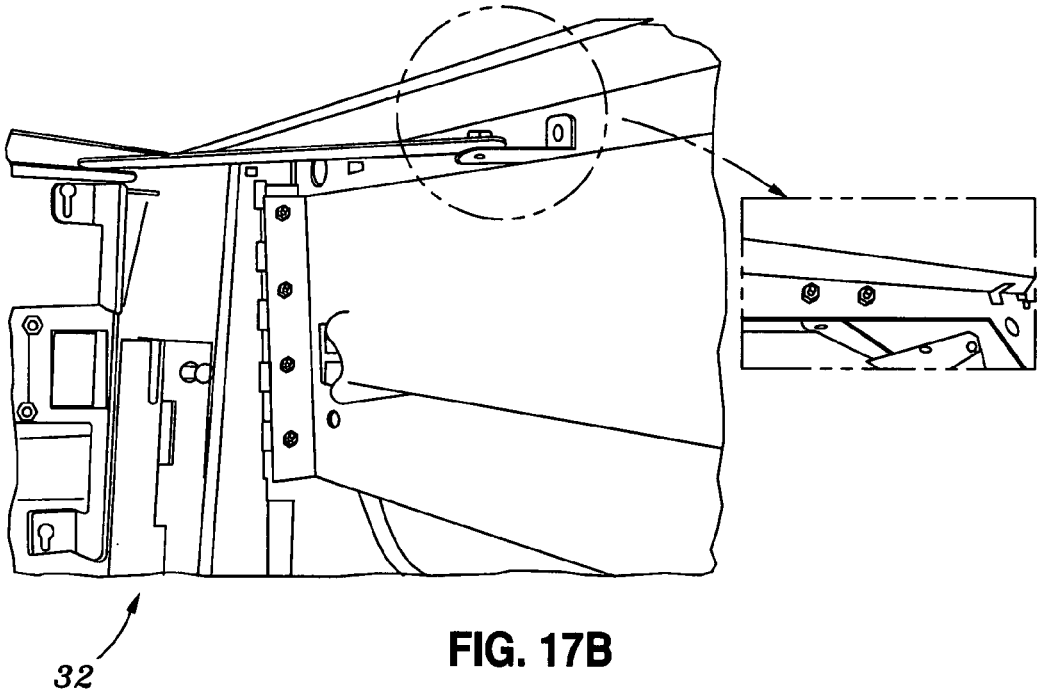
Figure 18A:
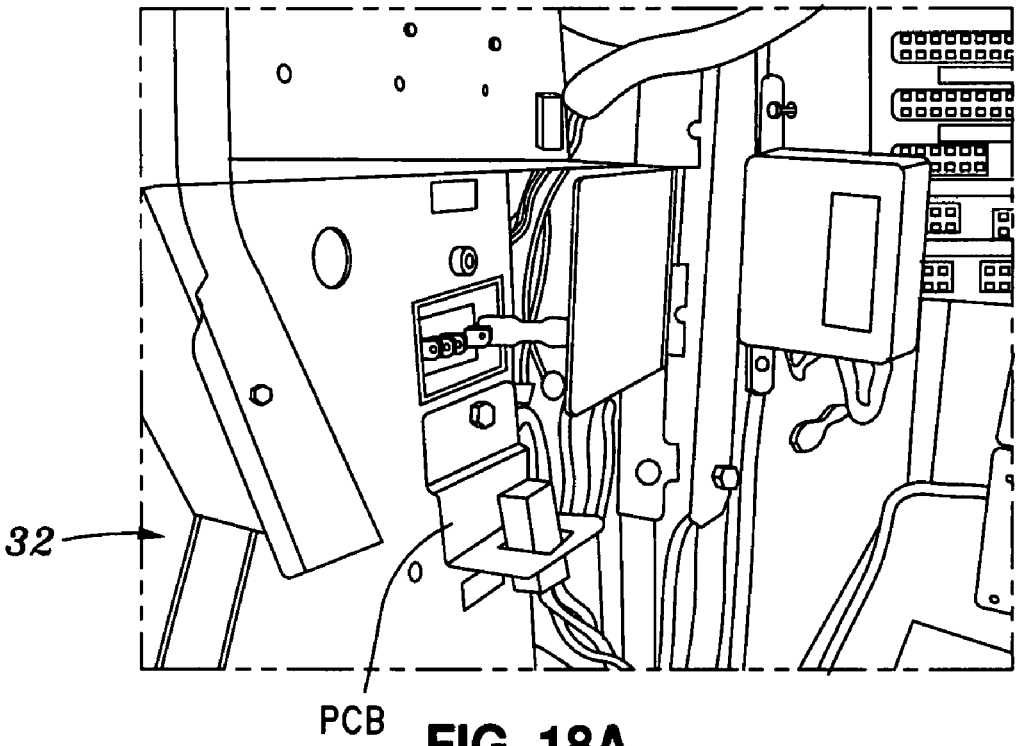
Figure 18B:
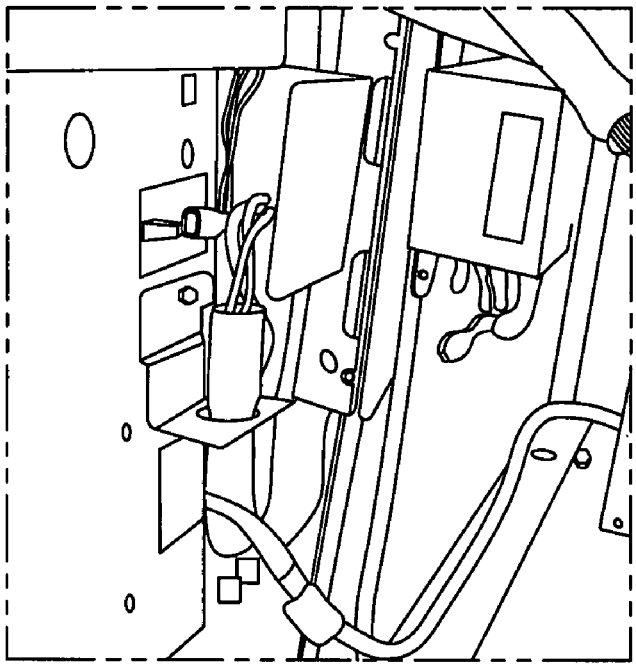
Figure 19A:
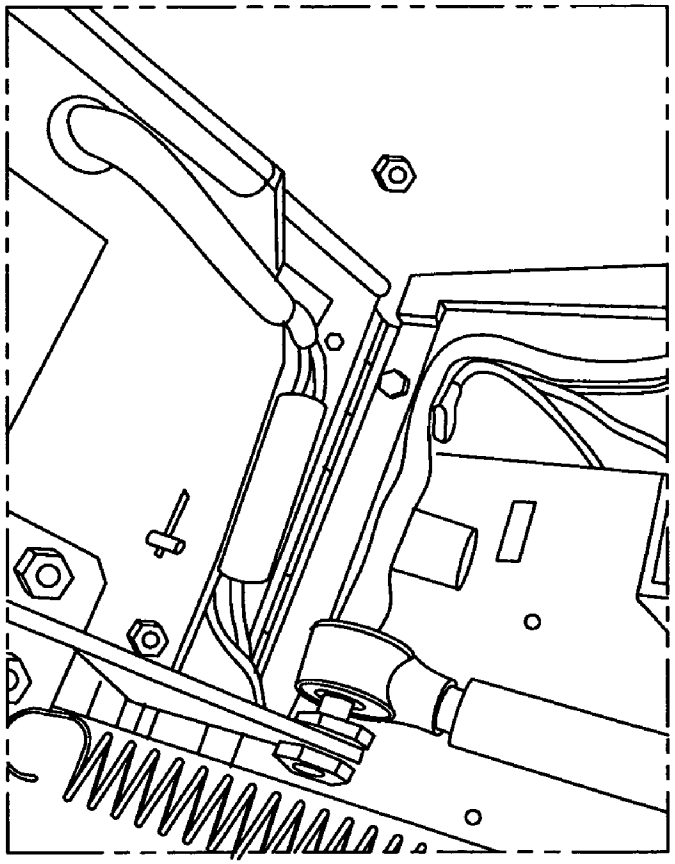
Figure 19B:
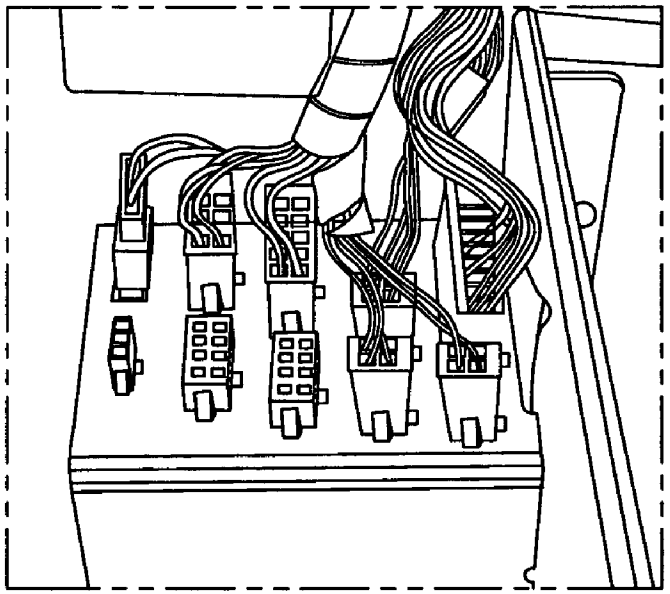
Figure 20:
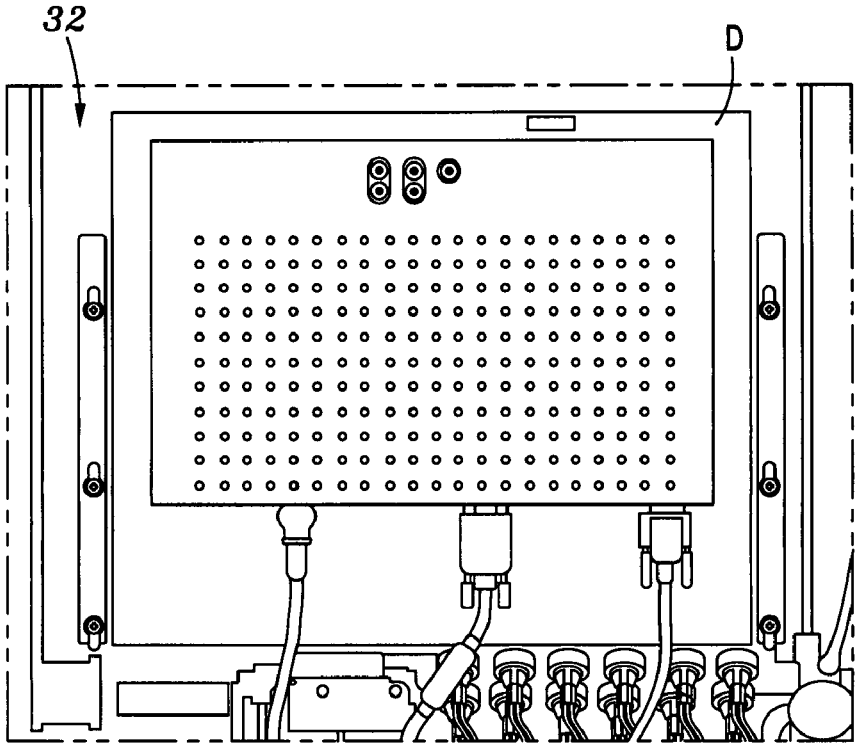

Once the components of the modular cabinet 20 arrive at their intended destination, they may be connected in the manner detailed above and illustrated in FIGS. 8-20. As illustrated in FIG. 8A, the left side 24 may be connected to the back 28, preferably with fasteners. As illustrated in FIG. 8B, the right side 26 may then be connected to the back 28, preferably with fasteners. As illustrated in FIG. 9A, the base or bottom 22 may be connected to the back, left and right sides 24, 26, 28, preferably with fasteners. As illustrated in FIG. 9B, the top 30 may be connected to the back, left and right sides 24, 26, 28, preferably with fasteners. As illustrated in FIG. 10A, a stiffener S may be attached to the cabinet, such as the left and right sides 24, 26, preferably with fasteners. As illustrated in FIG. 10B, a mounting shelf SH may be attached to the cabinet, such as to the left side 24 and back 28, preferably with fasteners. As illustrated in FIG. 11A, a bill validator housing H is connected to the cabinet, such as by connection to the right side 26 thereof. As illustrated in FIG. 11B, a door switch bracket assembly SW may be connected to the cabinet. As illustrated in FIG. 12A, a door harness panel P may be connected to the cabinet, such as to the shelf SH. As illustrated in FIG. 12B, a communication bracket CB is connected to the cabinet. As illustrated in FIG. 13A, the fan on the left side 24 may be connected to fan cable FC of a main harness of the cabinet (which main harness might initially be associated with the back 28 thereof before assembly of the cabinet). As illustrated in FIG. 13B, a ballast assembly connector BAC may also be connected to appropriate cabling associated with the main harness. As illustrated in FIG. 14A, a service lamp SL assembly may be connected to appropriate cabling of the main harness. As illustrated in FIG. 14B, appropriate harnesses may be connected to various key switches KS. As illustrated in FIG. 15A, a CPU light may be connected to the cabinet. As illustrated in FIG. 15B, the currency validator V may be mounted in the previously installed housing and then connected to the appropriate harnesses/cables. As illustrated in FIG. 16A, a coin hopper harness may be connected to appropriate cabling of the main harness. As illustrated in FIG. 16B, a service lamp may be connected to appropriate cabling of the main harness. As illustrated in FIG. 17A, the door 32 may be connected to the cabinet, preferably by appropriate hinges. As illustrated in FIG. 17B, a door open bracket assembly may be connected to the cabinet, such as the previously installed stiffener S. As illustrated in FIG. 18A, a bottom power connector bracket PCB may be connected to the door 32. As illustrated in FIG. 18B, a belly light jumper harness may be connected to an appropriate belly light harness. As illustrated in FIG. 19A, the belly light jumper harness may then also be connected to the belly light. As illustrated in FIG. 19B, connectors associated with a main door harness may be connected to the main harness. As illustrated in FIG. 20, the display D may be connected to the door 32, such as with fasteners.

The steps just detailed comprise one embodiment of a method of assembling the cabinet. As indicated, during assembly, additional components to those forming the housing may be associated with the cabinet (such as braces, a coin hopper, bill validator, display and the like). Further, as detailed, various of the steps comprise connecting various electrical components and their associated connectors/cabling. As indicated, many of such components may be pre-associated with a particular portion of the cabinet, such as the back or sides, before such components are assembled. The result of the assembly is a universal presentation platform 100.

A gaming device 200 may then be associated with the universal presentation platform 100. The gaming device 200 may be of a variety of types, such as described above. Once the gaming device 200 is associated with the universal presentation platform 100, the result is a gaming machine capable of presenting one or more games to a player. In the preferred embodiment, these games are wagering type games where a player bets or risks monies, credits, points or the like for the opportunity to win monies, points, prizes or the like.

Importantly, the gaming device 200 may be manufactured by the manufacturer of the universal presentation platform 100 or by one or more third parties. In addition, since the universal presentation platform 100 may accept different gaming devices 200, those gaming devices 200 may be obtained from a variety of different suppliers.

The gaming device 200 may be configured in various manners. In one embodiment, the gaining device 200 may be configured as a stand-alone controller which is capable of presenting a game independent of data supplied by outside device(s). In another embodiment, the gaming device 200 may be configured with a number generator but be configured to accept other game data (such as executable code) which is downloaded from a remote device (such as a remote game server). In yet another embodiment, the gaming device 200 may be configured to simply accept game results which are generated from a remote location (i.e. the gaming device 200 is a "terminal").

Because the gaming device 200 is a self-contained unit, it can be tested separately from the universal presentation platform 100, before it is shipped or associated with a particular universal presentation platform 100.

As one aspect of the invention, the gaming device 200 is preferably approved by appropriate regulatory authorities independent of any approval of the universal presentation platform 100. In this manner, the gaming device 200 can be used with any universal presentation platform 100, including being moved from one platform to another, without having to have the entire combination approved. The platform 100 may also be approved. However, in such event, since all the platforms 100 are alike, only one platform 100 may need to be approved while the gaming devices 200 can be approved independently.

It will be appreciated that the gaming device of the invention, including the modular cabinet, universal presentation platform and gaming device, may have a variety of configurations. In addition, various of the aspects of the invention may be applied to cabinets and machines other than those described specifically herein.

In one embodiment, the gaming cabinet of the invention is configured as an "upright" cabinet. The gaming cabinet could have other configurations, such as "slant-top", "bar-top", "console" and the like, and still have various of the aspects and features of the invention.

Figure 27A:
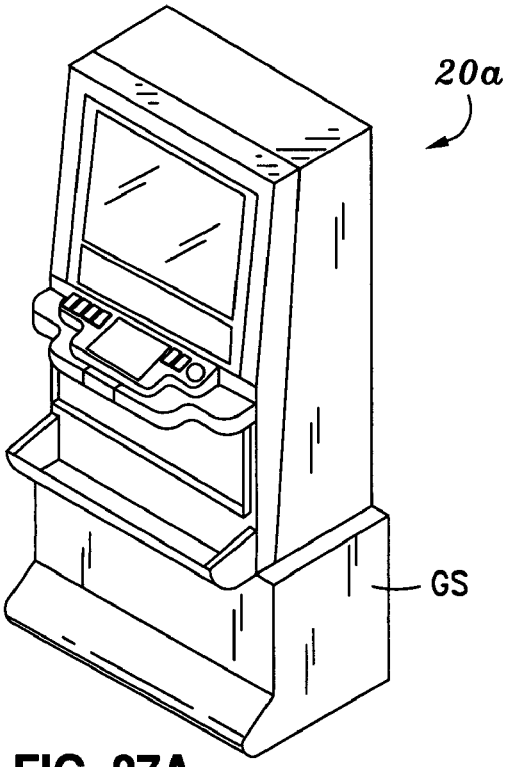
FIG. 27A is a perspective view of a modular gaming cabinet having abase configuration in accordance with an embodiment of the invention.
Figure 27B:
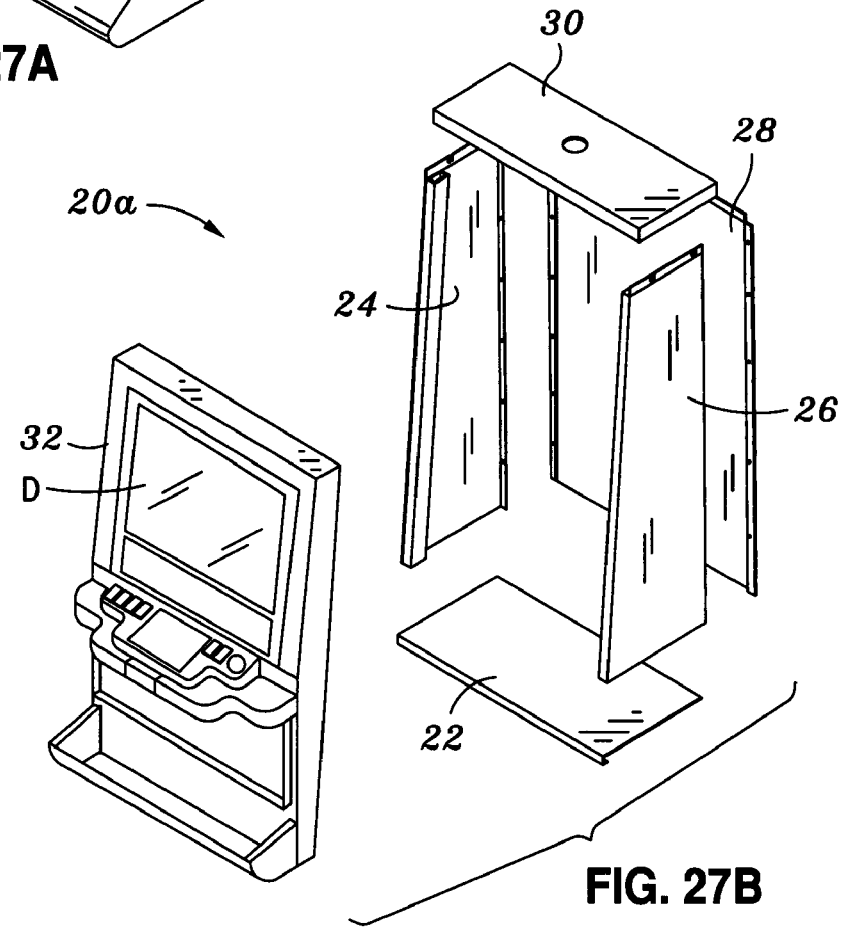
FIG. 27B is an exploded view of the modular gaming cabinet illustrated in FIG. 27A.

The principles of the invention may be utilized to create gaming machines having a variety of configurations. Referring to FIG. 27A, the modular gaming cabinet 20*a* may have a first, base or standard configuration. As illustrated in FIG. 27B, this base modular gaming cabinet 20*a* configuration may comprise a base 22, first and second sides 24, 26, a back 28, a top 30 and a door 32, similar to the configuration described above and illustrated in FIG. 1.

This base modular gaming cabinet 20*a* has a base size, determined by the dimensions of the components thereof. The base modular gaming cabinet 20*a* may be configured so that the door 32 thereof is sized to accommodate at least a single display D. As indicated above, this display might comprise rotating reels or other devices. However, the display D preferably comprises a video display, such as a flat panel display. Such a display might be of a variety of types and be of a variety of configurations and sizes. For example, as illustrated the door 32 might be configured to accommodate a wide-screen (such as a 16:9 or 16:10 aspect ratio) flat plane display in horizontal orientation. As illustrated, in one embodiment, the door 32 also supports or includes a coin tray, button panel and belly glass. However, the door 32 configuration of the basic modular gaming cabinet 20*a* configuration could vary.

Figure 28A:
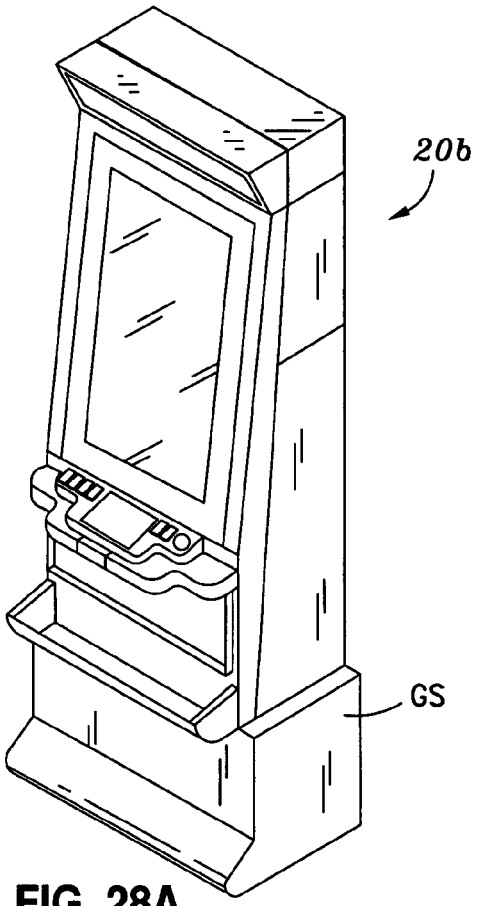
FIG. 28A is a perspective view of a modified modular gaming cabinet in accordance with an embodiment of the invention.

In a preferred embodiment of the invention, various gaming cabinets may be constructed using the basic modular gaming cabinet configuration. FIG. 28A illustrates a first modified modular gaming cabinet 20*b* in accordance with the invention.

Figure 28B:
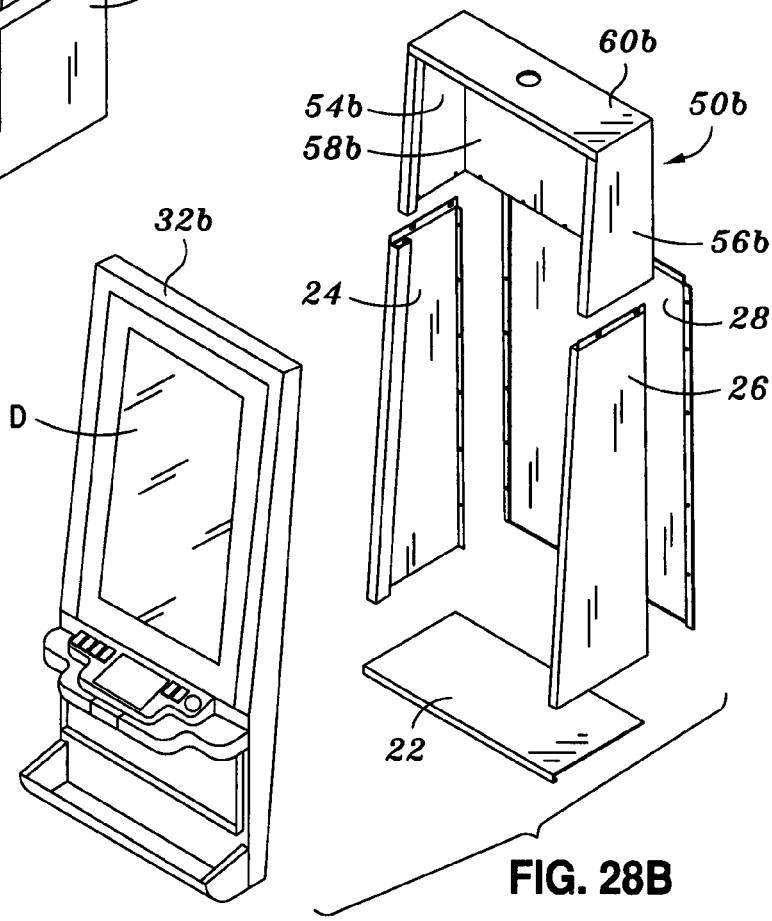
FIG. 28B is an exploded view of the modular gaming cabinet illustrated in FIG. 28A.

Referring to FIG. 28B, the modified modular gaming cabinet 20*b* preferably includes one or more components common to the basic modular gaming cabinet. In the embodiment illustrated, the modified modular gaming cabinet 20*b* comprises the same base 22, sides 24, 26 and back 28 as the basic modular gaming cabinet 20*a*.

In modified form, the gaming cabinet 20*b* includes an extension 50*b*. The extension 50*b* increases the size of the gaming cabinet from its basic configuration. In one embodiment, the extension 50*b* is configured to mount at the top of the sides 24, 26 and back 28, thus extending the gaming cabinet upwardly.

In one embodiment, the extension 50*b* has a pair of sides 54*b*, 56*b*, a back 58*b* and a top 60*b*. The sides 54*b*, 56*b* of the extension 50*b* correspond to an extend the sides 24, 26 of the gaming cabinet. Similarly, the back 58*b* of the extension 50*b* corresponds to the back 28 of the gaming cabinet.

In the preferred embodiment, the extension 50*b* defines extended portions of the shell or housing of the gaming cabinet. In this regard, the extension 50*b* cooperates with the remainder of the components of the cabinet 20*b* to preferably define a contiguous open interior area.

Figure 28C:
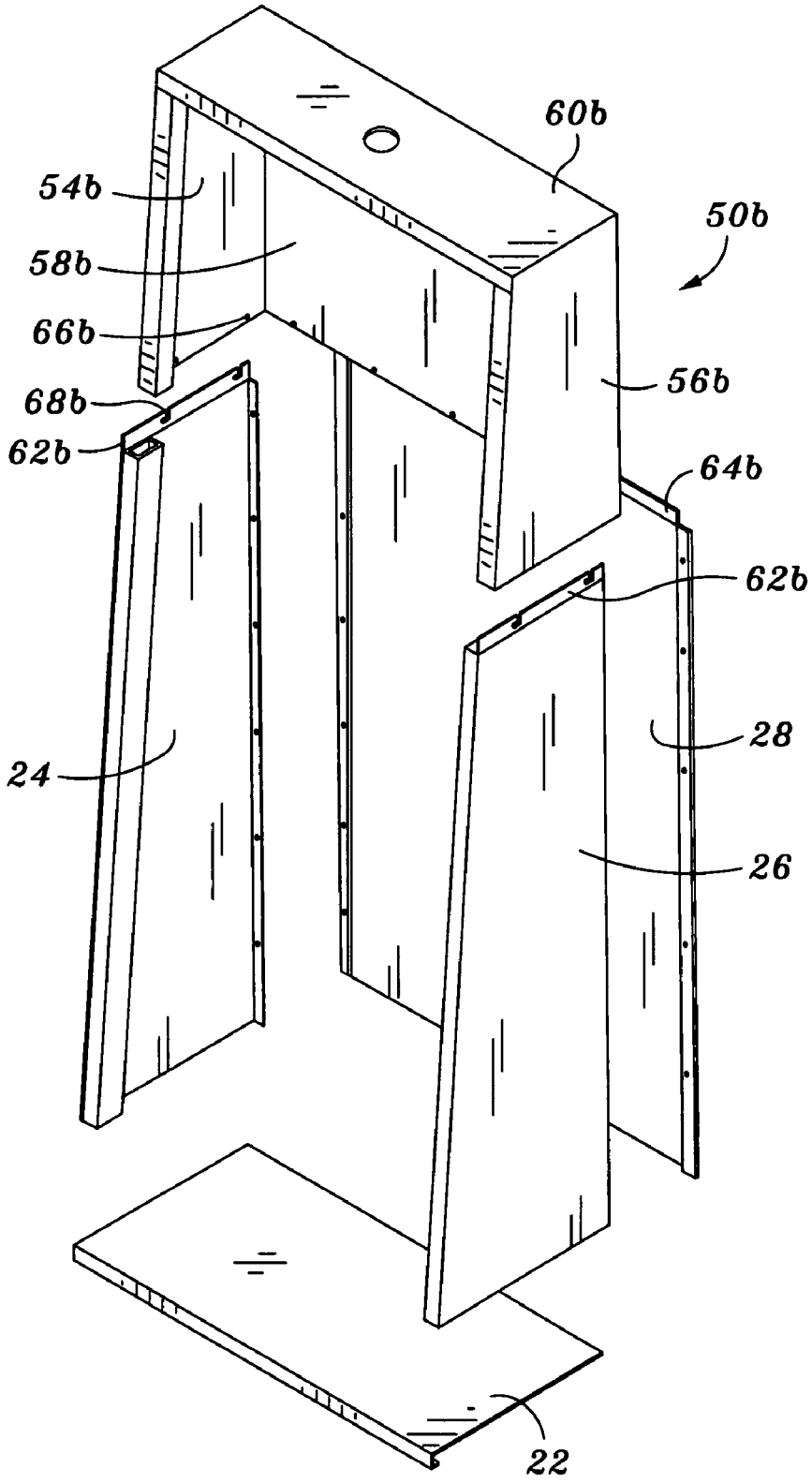
FIG. 28C is an enlarged view of a portion of the modular gaming cabinet illustrated in FIG. 28A illustrating in various components thereof in greater detail.

Referring to FIG. 28C, the extension 50*b* preferably connects to one or more of the base gaming cabinet components. In one embodiment, the extension 50*b* connects to the sides 24, 26 and back 28. Means may be provided for selectively connecting the extension 50*b* to the sides 24, 26 and back 28. In one embodiment, the means comprises one or more connectors. As illustrated, in one embodiment, a flange 62*b* is defined at the top of each of the sides 24, 26 of the cabinet 20*b*, and another flange 64*b* is defined at the top of the back 28. Preferably, the extension 50*b* connects to these flanges 62*b*, 64*b*.

In one embodiment, the extension 50*b* may connect to the sides 24, 26 and back 28 with one or more fasteners or other members. As illustrated, the extension 50*b* may be connected to the sides 24, 26 and/or back 28 with mating connectors, such as one or more pins or tabs 66*b* and mating slots 68*b*. As illustrated, pins 66*b* may extend from the inside of the extension 50*b* formatting engagement with slots 68*b* located in the flanges 62*b*, 64*b*. The extension 50*b* might also be connected to the sides 24, 26 and/or back 28*b* with screws, rivets or other fasteners.

Preferably, the extension 50*b* connects to the sides 24, 26 and back 28 in an overlapping configuration. In one such configuration, the outer surface of the sides 54*b*, 56*b* of the extension 50*b* and the sides 24, 26 of the cabinet 20*b* cooperate to define smooth, contiguous surfaces.

Referring again to FIG. 28B, the modified modular gaming cabinet 20*b* includes a door 32*b*. In this configuration, the door 32*b* is larger than that of the base modular gaming cabinet. In particular, the door 32*b* is taller, corresponding to the increase in height due to the extension 50*b*. In such an embodiment, the increased size of the door 32*b* may permit the door 32*b* to support or cooperate with a number of other gaming machine components. For example, the door 32*b* may support a display D. This display D may be much larger than the display used with the basic modular gaming cabinet. As illustrated, such a display D may be a wide-screen flat panel display which is mounted vertically.

Figure 29A:
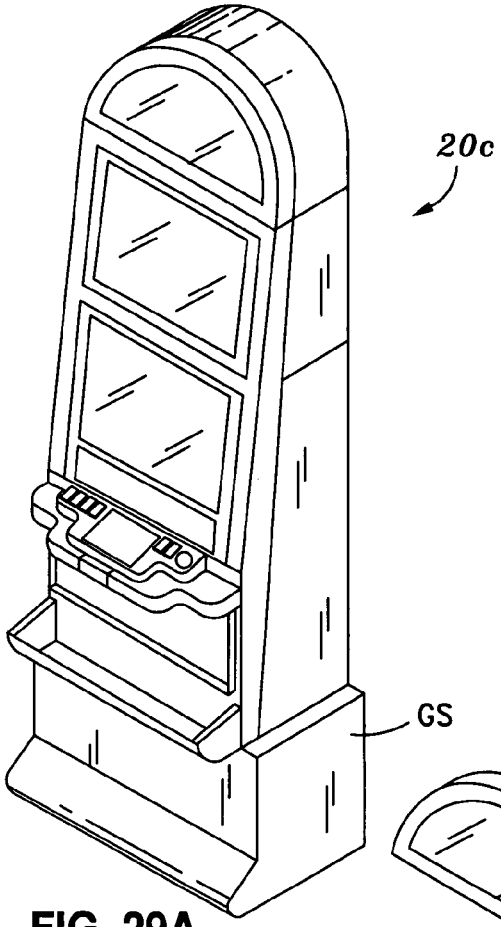
FIG. 29A is a perspective view of a modified modular gaming cabinet in accordance with yet another embodiment of the invention.
Figure 29B:
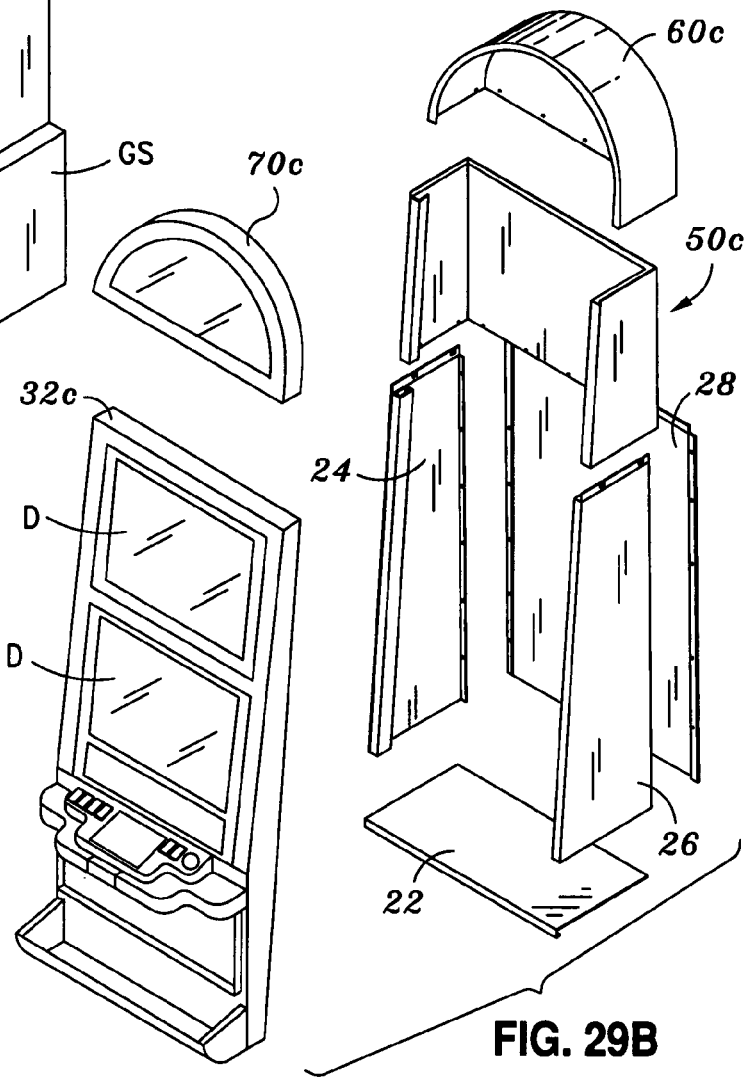
FIG. 29B is an exploded view of the modular gaming cabinet illustrated in FIG. 29A.

FIG. 29A illustrates yet another embodiment modified modular gaming cabinet 22*c* in accordance with the invention. As illustrated in FIG. 29B, the modified modular gaming cabinet 20*c* preferably again includes one or more components common to the basic modular gaming cabinet. In the embodiment illustrated, the modified modular gaming cabinet 20*c* comprises the same base 22, sides 24, 26 and back 28 as the basic modular gaming cabinet 20*a*.

In modified form, the gaming cabinet 20*c* includes an extension 50*c*. The extension 50*c* increases the size of the gaming cabinet from its basic configuration. In one embodiment, the extension 50*c* is configured to mount at the top of the sides 24, 26 and back 28, thus extending the gaming cabinet upwardly.

In one embodiment, the extension 50*c* has a pair of sides 54*c*, 56*c*, aback 58*c* and atop 60*c*. The sides 54*c*, 56*c* of the extension 50*c* correspond to and extend the sides 24, 26 of the gaming cabinet. Similarly, the back 58*c* of the extension 50*c* corresponds to the back 28 of the gaming cabinet.

In the preferred embodiment, the extension 50*c* defines extended portions of the shell or housing of the gaming cabinet. In this regard, the extension 50*c* cooperates with the remainder of the components of the cabinet 20*c* to preferably define a contiguous open interior area.

Like the top 60*b* of the extension 50*b* of the embodiment illustrated in FIG. 28B, the top 60*c* of this extension 50*c* may formed as a portion of the extension 50*c*. As illustrated, however, the top 60*c* may also be a separate element which is connectable to the extension 50*c*, such as in a similar manner as the extension 50*c* connects to the sides 24, 26 and back 28. It will be appreciated that such a configuration could apply to the other embodiments of the invention, including the embodiment illustrated in FIG. 28B.

In the embodiment illustrated, the top 60*c* is arch shaped. However, the top 60*c* could have a variety of other forms. As also illustrated, a cover 70*c* may be located at an otherwise open front portion of the top 60*c*. This cover 70*c* might comprise a translucent panel, screened glass or the like, such as for comprising display signage. Of course, one or more lights might be located in the top 60*c* for illuminating the cover 70*c*.

As with the previously described extension 28*b*, this extension 28*c* may be connected to the sides 24, 26 and back 28 in a variety of manners. In a preferred embodiment, the extension 28*c* again connects with one or more fasteners or other connectors, and preferably overlaps so that the exterior of the gaming machine has smooth, contiguous surfaces.

Once again, the cabinet 20*c* also includes a door 32*c*. Again, this door 32*c* is enlarged compared to the door 32 of the basic modular gaming cabinet 20*a*. In particular, the door 32*c* has larger dimension corresponding to the increase in size of the cabinet 20*c* due to the extension 50*c*. In one embodiment, the dimensions of the extension 50*c* of this modular gaming cabinet 20*c*, not including the top 60*c*, may be the same as the extension of the previous embodiment 20*b*. In this manner, the doors 32*b*, 32*c* may be the same size.

Of course, in such a configuration, the doors 32*b*, 32*c* could have the same configuration. As indicated, that configuration may vary. In such other configuration is illustrated in FIG. 29B. In particular, this door 32*c* is configured to accept or cooperate with two displays D. As illustrated, two displays D may be mounted in vertical relationship. For example, two wide-screen flat panel displays D may be mounted in horizontal positions, one above the other.

The gaming machine configurations illustrated in FIGS. 27A, 28A and 29A are merely examples of the variety of different configurations of gaming machines which may be created in accordance with the present invention. It will be appreciated that the gaming machines may include extensions having a variety of shapes and sizes. In one embodiment, one or more displays or other gaming components may be associated with or located in the extension. Likewise, the door of the gaming machine may be configured to include (such as by mounting directly thereto) one or more gaming machine components (such as displays, buttons and the like) or cooperate with (such as by being configured to close over) one or more of such components.

In one embodiment, the universal presentation platform is configured to receive the gaming device in a substantially horizontal position (by mating to the UGDI located on the back of the cabinet). The gaming device may be configured to be oriented in various positions. For example, in a reduced depth cabinet configuration, the gaming device may be oriented vertically or an at angle.

The modular cabinet of the invention has numerous benefits. A particular advantage is that the cabinet components can be shipped individually, in groups, in un-assembled form. This is a substantial advantage over shipping an assembled cabinet which is large/oversized and has a substantial volume of dead space. The modular configuration also permits the gaming cabinet or machine to be configured in a variety of manners, such as illustrated in FIGS. 27A, 28A and 29A.

One advantage of the modular or "component" configuration of the cabinet or housing is that it is standardized, reducing the cost of manufacture. Typically, gaming machines are custom configured in order that they may have unique appearances. Thus, each gaming machines is custom designed and built with unique components and specifications. This substantially increases the cost of creating gaming machines. In accordance with the invention, a gaming machine can be constructed from common basic components. These components can be produced in mass. At the same time, various gaming machine configurations can be achieved from the basic components with minor modification, such as by adding an extension. This allows a variety of gaming machines having different appearances to be manufactured at low cost.

One advantage to the invention is the manner in which the extension or addition to a gaming machine changes the size of the gaming machine. For some time, gaming machines have been modified by adding a top box. However, in this configuration, machine and the top box are generally discrete elements which are simply associated. Thus, the gaming machine is constructed with a closed housing or cabinet, so as to be used in stand-alone fashion. The top box is similarly constructed to be a closed box. The top box is mounted on the top of the closed gaming cabinet.

In accordance with the invention, the extension is an extension of the basic gaming machine housing or cabinet. Thus, the extension cooperates to define a common interior area to the gaming machine housing. In addition, the extension cooperates with the sides and back of the housing so that they appear to be one element or unit. Because the interior of the extension is integral of the interior of the housing, internal components such as electronics and the like may be conveniently located in the portion of the gaming machine defined by the extension.

An advantage of the "universal" configuration of the cabinet is that the cabinet can be mass-produced from a small number component parts, rather than having to have hundreds and hundreds of specialty component parts for a variety of different gaming machines. This reduces production costs.

One advantage of the invention is the grounding configuration of both the cabinet and the gaming device. Grounding is particularly important relative to a gaming machine to prevent shock (such as might occur when a player touches the machine) from entering the circuitry of the machine and interfering with the operation of the machine. Gaming regulations in many jurisdictions set very specific requirements relative to a gaming machine being "shock-proof."

Relative to the modular cabinet, a specific advantage of the configuration is that studs/bolts and nuts are used to connect the components. This configuration has advantages overuse of rivets and the like, which may "float" in the opening through which they pass and not at all times securely engage the metal of the housing. Instead, the studs/bolts and nuts form a strong mechanical and electrical connection with the metal forming the cabinet. In one embodiment, washers may be utilized with the nuts, the washers actually embedding themselves in the metal of the cabinet.

The gaming device is also grounded to the cabinet when it is connected thereto. In a preferred embodiment, one or more screws or similar fasteners actually pass through the housing of the gaming device into direct contact with the metal forming the housing (including the back). In this manner, a positive mechanical and electrical connection are formed between the cabinet and the gaming device. In one embodiment, this secure mounting also ensures that the connectors of the gaming device 200 securely engage the ports of the UGDI 102, ensuring integrity of the signal pathway there between.

A particular advantage of the universal presentation platform is that it can accept a variety of different gaming devices. A casino may, for example, purchase a number of presentation platforms. The casino can then lease or purchase gaming devices and associate those devices with the platforms. The gaming devices can be swapped and changed, preferably without requiring any regulatory approval (since the gaming devices are approved independent of the platforms). This allows, for example, a casino to elect to configured a particular number of gaming machines to present a particular game, such as video poker. If the demand for that game is high, they can easily convert other machines presenting other games to that game, simply by changing the gaming device associated with various of the presentation platforms.

A casino may also elect to modify a gaming device. A casino might elect, for example, to upload new gaming code or content to a particular gaming device, thus permitting the gaming device to be configured to present a new or different game. In the case where the casino, a licensed gaming entity, uploads new graphics only (and doesn't change the game code per se or the method of play), then the casino may make changes without even having to have the gaming device re-approved.

Another advantage to the separate "gaming device" configuration is that the gaming device can easily be modified or changed. As detailed, in the prior art, the circuitry of the entire gaming machine is generally uniquely designed. Specific components, wiring and the like are utilized in such a design. Modification of any of the components is often not possible since other components will not often accommodate such changes. On the other hand, the gaming devices of the invention may have a variety of configuration and the gaming devices will still operate with the presentation platform. As described, for example, the gaming device may use a processor (of one or more types) or a dedicated game board, among many configurations.

In one embodiment, the universal presentation platform may be configured to authenticate a gaming device. For example, the presentation platform may be configured with a logic board containing verification data. That data may be compared to gaming device data when a gaming device is associated with the presentation platform. In another embodiment, verification could be performed externally. In this manner, it can be ensured that a gaming device which is associated with a presentation platform is authentic. If a gaming device is not confirmed as authentic, the presentation platform may be configured to block signals (such as through the UGDI) to prevent the presentation of games.

The venting and filtering configuration of the invention is useful in maintaining trouble-free operation of the machine. It will be appreciated that these and other features of the invention may be applied to gaming machines having other configurations (such as those which do not have modular cabinets or are not configured to accept a variety of gaming devices).

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of creating a gaming machine in at least two different configurations comprising the steps of:

providing a base gaming machine configuration, said base gaming machine comprising a base housing configuration comprising a first set of components, said first set of components comprising a base, a back connectable to said base, a first side connectable to said base and back, a second side connectable to said base and back, a first top connectable to said base, first side and second side, and a first door connectable to said first or second side, said first set of components when connected defining said base housing configured to support one or more gaming machine components and having an interior area of a first size;

providing a modified gaming machine configuration, said modified gaming machine comprising a modified housing comprising a second set of components, said second set of components comprising said base, said first side, said second side and said back of said base housing configuration, and an extension comprising at least one member connectable to said first side, second side and back to extend said first side, second side and back, and said at least one member of said extension defining a second top, and a second door connectable to said first or second side, said second set of components when connected defining said modified housing configured to support one or more gaming machine components and having an interior area of a second size larger than said first size;

selecting the desired gaming machine configuration; and assembling the set of components corresponding thereto.

2. The method in accordance with claim 1 wherein said second door has a height which is greater than a height of said first door.

3. The method in accordance with claim 1 wherein said modified housing has a height which is greater than a height of said base housing.

4. The method in accordance with claim 1 wherein said first and second doors are movably connected to said base and modified housings, respectively, to selectively permit access to the interior area of said base or modified housings.

* * * * *